US008710454B2

(12) United States Patent
Chen

(10) Patent No.: US 8,710,454 B2
(45) Date of Patent: Apr. 29, 2014

(54) HIGH GRADIENT LENS FOR CHARGED PARTICLE BEAM

(75) Inventor: Yu-Jiuan Chen, Fremont, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 183 days.

(21) Appl. No.: 13/343,700

(22) Filed: Jan. 4, 2012

(65) Prior Publication Data

US 2012/0168639 A1 Jul. 5, 2012

Related U.S. Application Data

(60) Provisional application No. 61/429,681, filed on Jan. 4, 2011, provisional application No. 61/528,573, filed on Aug. 29, 2011.

(51) Int. Cl.
*H01J 1/50* (2006.01)

(52) U.S. Cl.
USPC ..... 250/396 R; 250/283; 250/288

(58) Field of Classification Search
USPC ..... 250/283, 288, 492.3, 396 R
See application file for complete search history.

(56) References Cited

U.S. PATENT DOCUMENTS

| | | | | |
|---|---|---|---|---|
| 3,308,323 | A * | 3/1967 | Van De Graaff | 313/360.1 |
| 6,066,961 | A | 5/2000 | Lee et al. | |
| 7,576,499 | B2 | 8/2009 | Caporaso et al. | |
| 7,710,051 | B2 | 5/2010 | Caporaso et al. | |
| 7,982,183 | B2 * | 7/2011 | Makarov et al. | 250/283 |
| 8,148,679 | B2 * | 4/2012 | Makarov et al. | 250/283 |
| 8,148,680 | B2 * | 4/2012 | Makarov et al. | 250/283 |
| 2012/0168639 | A1 * | 7/2012 | Chen | 250/396 R |
| 2012/0181456 | A1 * | 7/2012 | Chen | 250/492.3 |
| 2013/0140468 | A1 * | 6/2013 | Chen | 250/396 R |

OTHER PUBLICATIONS

Syms, et al., "Two-dimensional microfabricated electrostatic einzel lens", Sensors and Actuators, A 107, pp. 285-295 (2003).

* cited by examiner

*Primary Examiner* — Nikita Wells
*Assistant Examiner* — Johnnie L Smith
(74) *Attorney, Agent, or Firm* — Perkins Coie

(57) ABSTRACT

Methods and devices enable shaping of a charged particle beam. A dynamically adjustable electric lens includes a series of alternating a series of alternating layers of insulators and conductors with a hollow center. The series of alternating layers when stacked together form a high gradient insulator (HGI) tube to allow propagation of the charged particle beam through the hollow center of the HGI tube. A plurality of transmission lines are connected to a plurality of sections of the HGI tube, and one or more voltage sources are provided to supply an adjustable voltage value to each transmission line of the plurality of transmission lines. By changing the voltage values supplied to each section of the HGI tube, any desired electric field can be established across the HGI tube. This way various functionalities including focusing, defocusing, acceleration, deceleration, intensity modulation and others can be effectuated on a time varying basis.

38 Claims, 17 Drawing Sheets

HIGH GRADIENT LENS FOR CHARGED PARTICLE BEAM

CROSS-REFERENCE TO RELATED APPLICATIONS

This patent document claims the benefits and priorities of U.S. Provisional Application No. 61/528,573, filed on Aug. 29, 2011, and U.S. Provisional Application No. 61/429,681, filed on Jan. 4, 2011, which are hereby incorporated by reference.

FEDERALLY SPONSORED RESEARCH OR DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

TECHNICAL FIELD

This patent document relates to focusing or defocusing of a charged particle beam, associated devices, systems and methods, including applications in particle accelerators, including linear particle accelerators that use dielectric wall accelerators.

BACKGROUND

Charged particles include positively charged particles (e.g., protons and positive ions), and negatively charged particles (e.g., electrons and ions). In various devices, systems and applications, a beam of charged particles can be controlled to propagate (i.e. transported) towards a destination or target with a desired energy and beam profile. The beam profile can be controlled by using one or more charged particle lenses to focus, defocus or collimate the charged particle beam in a way similar to focusing, defocusing or collimating a beam of light using one or more optical lenses.

Charged particle lenses can be implemented in various ways, including magnetic lenses that use magnetic fields to control the charged particle beam profile or electrostatic lenses that use electrodes to produce a desired electric field profile for controlling the charged particle beam profile. One example of devices and systems based on charged particle beams is particle accelerators that increase the energy of electrically-charged particles, e.g., electrons, protons, or charged atomic nuclei. High energy electrically-charged atomic particles are accelerated to collide with target atoms, and the resulting products are observed with a detector. At very high energies the charged particles can break up the nuclei of the target atoms or molecules and interact with other particles. Transformations are produced that help to discern the nature and behavior of fundamental units of matter. Particle accelerators are also important tools in the effort to develop nuclear fusion devices, as well as in medical applications such as proton therapy for cancer treatment.

Proton therapy uses a beam of protons to irradiate diseased tissue, most often in the treatment of cancer. The proton beams can be utilized to more accurately localize the radiation dosage and provide better targeted penetration inside the human body when compared with other types of external beam radiotherapy. Due to their relatively large mass, protons have relatively small lateral side scatter in the tissue, which allows the proton beam to stay focused on the tumor with only low-dose side-effects to the surrounding tissue.

The radiation dose delivered by the proton beam to the tissue is at or near maximum just over the last few millimeters of the particle's range, known as the Bragg peak. Tumors closer to the surface of the body are treated using protons with lower energy. To treat tumors at greater depths, the proton accelerator must produce a beam with higher energy. By adjusting the energy of the protons during radiation treatment, the cell damage due to the proton beam is maximized within the tumor itself, while tissues that are closer to the body surface than the tumor, and tissues that are located deeper within the body than the tumor, receive reduced or negligible radiation.

Proton beam therapy systems are traditionally constructed using large accelerators that are expensive to build and hard to maintain. However, recent developments in accelerator technology are paving the way for reducing the footprint of the proton beam therapy systems that can be housed in a single treatment room. Such systems often require newly designed, or re-designed, subsystems that can successfully operate within the small footprint of the proton therapy system, reduce or eliminate health risks for patients and operators of the system, and provide enhanced functionalities and features.

In order to increase the effectiveness of radiation therapy, it is advantageous to be able to rapidly and dynamically vary the spot size of the charged particle beam at the targeted area, and to enable focusing and defocusing of the charged particle. Such capabilities, however, can be difficult to implement in various compact accelerator configurations.

SUMMARY

The technology described in this patent document includes devices, systems and methods for focusing or defocusing of a charged particle beam and various applications such as particle accelerators, medical instrument and other devices or systems that involve charged particle beams.

In one implementation, a high gradient lens is provided to include a series of alternating layers of insulators and conductors stacked to one another to form a high gradient insulator (HGI) tube having sections with a hollow center to allow propagation of a charged particle beam of charged particles through the hollow center; a plurality of transmission lines connected to the sections of the HGI tube; and a lens control module configured to supply adjustable voltages the transmission lines, respectively, to thereby establish an adjustable electric field profile over the sections of the HGI tube to effectuate a lens that modifies a spatial profile of the charged particle beam at an output of the HGI tube to achieve a desired beam focusing or defocusing operation.

In another implementation, a method of shaping a charged particle beam is provided to include directing a charged particle beam into a plurality of sections of a high gradient lens, wherein the high gradient lens comprises a series of alternating layers of insulators and conductors stacked to form a high gradient insulator (HGI) tube having sections with a hollow center to allow propagation of the charged particle beam through the hollow center of the HGI tube; and applying adjustable voltages to the sections of the HGI tube to establish a desired electric field at each section and across the sections to modify a spatial profile of the charged particle beam to achieve a desired beam focusing or defocusing operation.

In another implementation, a charged particle accelerator system is provided to include a charged particle source configured to produce a charged particle beam; and a high gradient lens configured to receive and shape the charged particle beam. The high gradient lens includes a series of alternating layers of insulators and conductors to form a high gradient insulator (HGI) tube having sections with a hollow center to allow propagation of the charged particle beam through the hollow center. A plurality of transmission lines are connected to a plurality of sections of the HGI tube. One or more voltage sources are configured to supply an adjustable voltage value to each transmission line of the plurality of transmission lines. This system includes a dielectric wall accelerator configured to accelerate the charged particle beam; and a timing and control component configured to produce timing and control signals to the charged particle source, the high gradient lens and the dielectric wall accelerator.

In another implementation, a method for operating a charged particle beam accelerator is provided to include directing a charged particle beam produced by an charged particle source through a high gradient lens to a dielectric wall accelerator. The high gradient lens includes a series of alternating layers of insulators and conductors with a hollow center, the series of alternating layers stacked together to form a high gradient insulator (HGI) tube to allow propagation of the charged particle beam through the hollow center of the HGI tube, a plurality of transmission lines connected to a plurality of sections of the HGI tube, and one or more voltage sources configured to supply an adjustable voltage value to each transmission line of the plurality of transmission lines to achieve focusing or defocusing of the charged particle beam. This method includes adjusting the one or more voltage sources to change an electric field at one or more of the plurality of the sections of the HGI tube and to thereby modify the focusing or defocusing of the charged particle beam.

In yet another implementation, a method for treatment of a patient using a charged particle accelerator system includes irradiating one or more target areas within the patient's body with a charged particle beam that is output from the charged particle beam accelerator system. The charged particle accelerator system includes a charged particle source configured to produce the charged particle beam and a high gradient lens configured to shape the charged particle beam. The high gradient lens includes a series of alternating layers of insulators and conductors with a hollow center and the series of alternating layers are stacked together to form a high gradient insulator (HGI) tube to allow propagation of the charged particle beam through the hollow center of the HGI tube. The lens also includes a plurality of transmission lines connected to a plurality of sections of the HGI tube, and one or more voltage sources configured to supply an adjustable voltage value to each transmission line of the plurality of transmission lines. The system includes a dielectric wall accelerator that is configured to accelerate the charged particle beam and a timing and control component configured to produce timing and control signals to the charged particle source, the high gradient lens and the dielectric wall accelerator. The method includes adjusting the one or more voltage sources to establish a desired electric field at each of the plurality of the sections of the HGI tube and to thereby modify at least one characteristic of the charged particle beam at the one or more target areas.

These and other implementations and various features and operations are described in greater detail in the drawings, the description and the claims.

DETAILED DESCRIPTION

Figure 1:
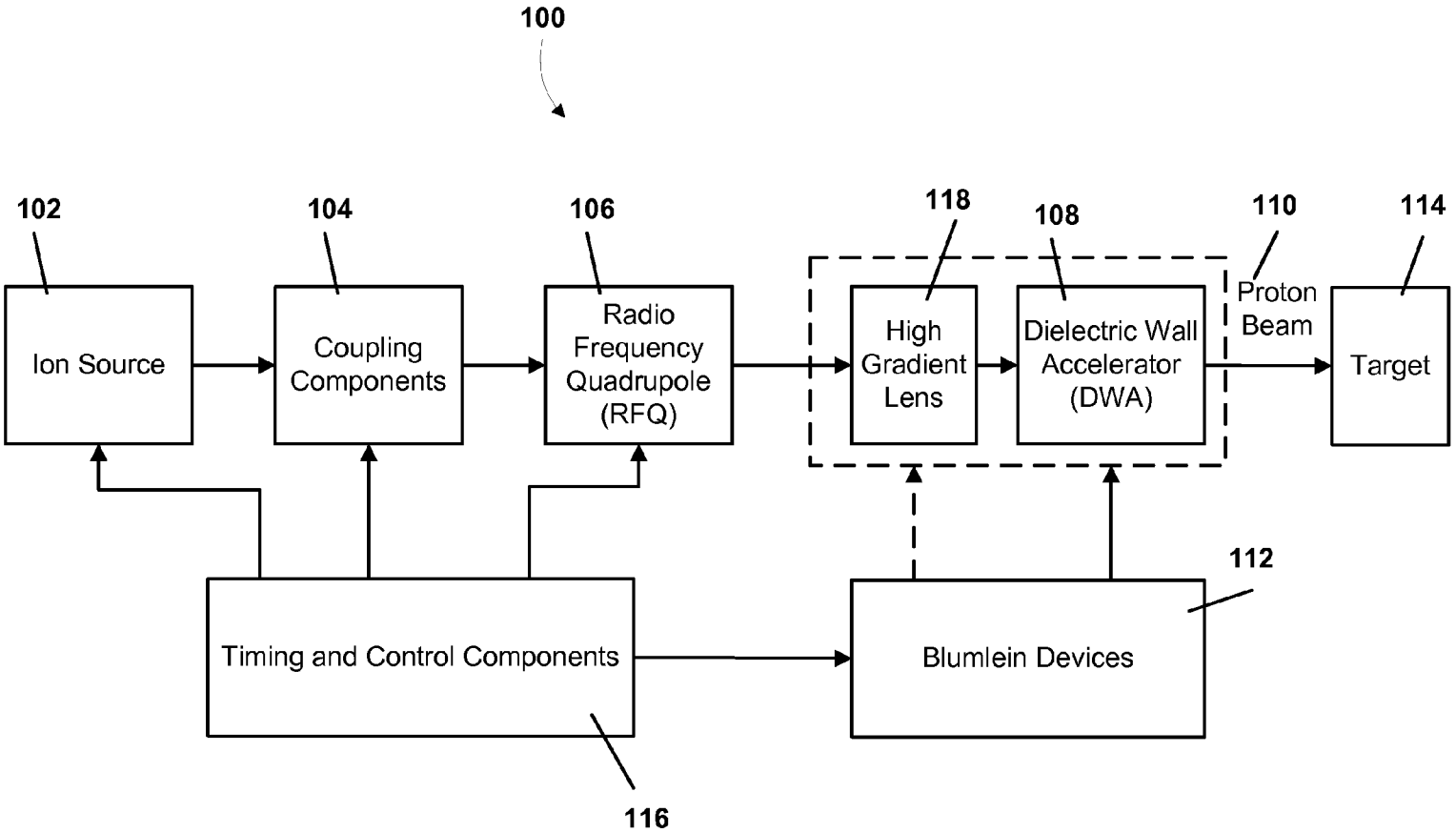
FIG. 1 is a block diagram of a linear particle accelerator that can accommodate the disclosed embodiments of the described technology.

This patent application provides examples of high gradient lens designs based on a series of alternating layers of insulators and conductors that are stacked to one another to form a high gradient insulator (HGI) tube. Such a HGI tube includes sections with a hollow center to allow propagation of a charged particle beam of charged particles through the hollow center. Electrically conductive transmission lines are connected to sections of the HGI tube to apply control voltages to the HGI tube. A lens control module is configured to supply adjustable control voltages via the transmission lines, respectively, to thereby establish an adjustable electric field profile over the sections of the HGI tube to effectuate a lens that modifies a spatial profile, e.g., the radial profile, of the charged particle beam at an output of the HGI tube to achieve a desired beam focusing or defocusing operation. This adjustable HGI tube is a charged particle transport device that allows adjusting the voltages to modify the particle propagation and energy parameters as the particle passes through the HGI tube. Therefore, a HGI lens is an adjustable charged particle lens and allows the same lens structure to provide various lens operations that may be difficult to achieve with a single lens in other lens designs.

Such a high gradient lens may used in various devices or systems that involve charged particle beams, such as particle accelerators. One example of accelerator configurations is a linear accelerator with a charged particle source or an injector, a matching section and an accelerator. The accelerator could be an RF accelerator, an induction accelerator, a DWA accelerator or other accelerator designs. High gradient lens designs described in this patent document can be configured to adopt to various accelerator configurations, for example, between any of two components mention above, or in the matching section, or in the accelerator or after the accelerator. In addition, the high gradient lens designs described in this patent document may be used in a circular accelerator configuration to adjust the focusing settings of such a lens from turn to turn in a circular accelerator configuration, especially in some re-circulating accelerator configurations where charged particles are confined, guided and accelerated in a closed loop multiple times to get accelerated in the closed loop such as a circular or nearly circular loop in cyclotron systems. The adjustment of the focusing settings of such a lens from turn to turn in the circular accelerator configuration can be used to achieve certain operational effects, e.g., optimizing the beam transport in the circular accelerator as the energy of the particles increase by circulating in the accelerator. Such adjustable focusing settings tend to be difficult to implement with other lens designs such as focusing magnets and electrostatic lenses. In operation, for example, the high gradient lens can be placed in a circular accelerator to control focusing of the charged particle beam which is accelerated by the circular accelerator and the applied adjustable voltages to the sections of the HGI tube can be adjusted to vary beam focusing at different turns of the charged particle beam circulating in the circular accelerator.

If the accelerator is a DWA accelerator, different implementations can be used to provide a bunched ion beam to the DWA via beam focusing. One specific example for implementing a high gradient lens in a DWA is provided in FIG. 1.

FIG. 1 illustrates a simplified diagram of a linear particle accelerator (linac) 100 that can accommodate the disclosed embodiments for a HGI lens. For simplicity, FIG. 1 only depicts some of the components of the linac 100. Therefore, it is understood that the linac 100 can include additional components that are not specifically shown in FIG. 1. It should also be noted that while some of the disclosed embodiments are described in the context of the exemplary linear accelerator 100 of FIG. 1, it is understood that the disclosed embodiments can be used in other systems and in conjunction with other applications that can benefit from dynamically shaping a charged particle beam.

Referring back to FIG. 1, a charged particle source, such as exemplary ion source 102, produces a charged particle beam that is coupled to a radio frequency quadrupole (RFQ) 106 using coupling components 104. The coupling components 104 can, for example, include components such as one or more Einzel lenses that provide a focusing/defocusing mechanism for the charged particle beam (e.g., a proton beam) that is input to the RFQ 106. The RFQ 106 provides focusing, bunching and acceleration for the charged particle beam. One exemplary configuration of a radio frequency quadrupole includes an arrangement of four triangular-shaped vanes that form a small hole, through which the proton beam passes. The edges of the vanes at the central hole include ripples that provide acceleration and shaping of the beam. The vanes are RF excited to accelerate and shape the ion beam passing therethrough.

In the specific example in FIG. 1, the charged particle beam output by RFQ 106 is coupled to a dielectric wall accelerator (DWA) 108 that further accelerates the beam to produce an output charged particle beam, shown as an exemplary proton beam 110. The output charged particle beam (e.g., the proton beam 110) is delivered to the target 114, such as a tumor within a patient's body in cancer therapy applications. The high gradient lens 118, as will be described in detail in the sections that follow, can be dynamically and rapidly configured to vary several characteristics of the charged particle beam, including but not limited to focusing/defocusing, accelerating/decelerating and varying the output beam's spot size, on an as-needed basis. FIG. 1 also shows Blumlein devices 112 that are used to deliver voltage pulses to the DWA 108 and/or to the high gradient lens 118. The timing and control components 116 provide the necessary timing and control signals to the various components of the linac 100 to ensure proper operation and synchronization of those components. For example, the timing and control components 116 can be used to control the timing and value of voltages that are applied to the high gradient lens 118 and/or the DWA 108.

Figure 2A:
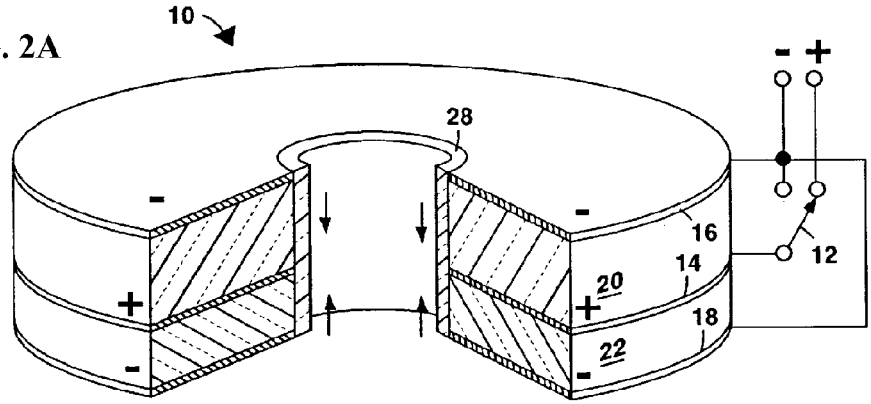
FIGS. 2A-2D illustrate the structure and operations of a dielectric wall accelerator that can be used in conjunction with the disclosed embodiments.
Figure 2B:
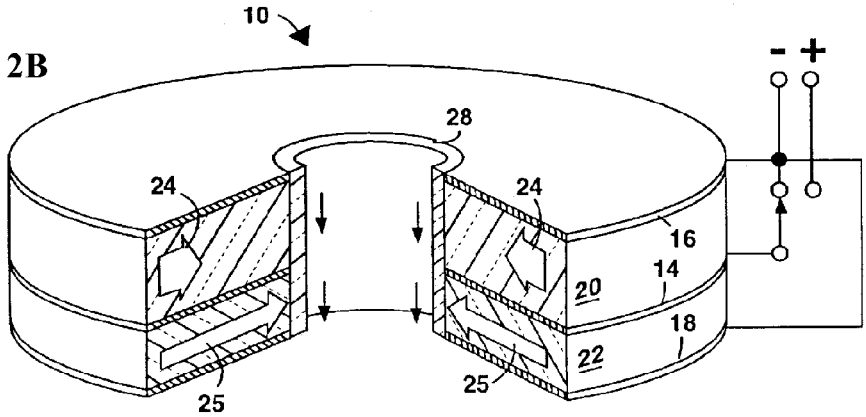
Figure 2C:
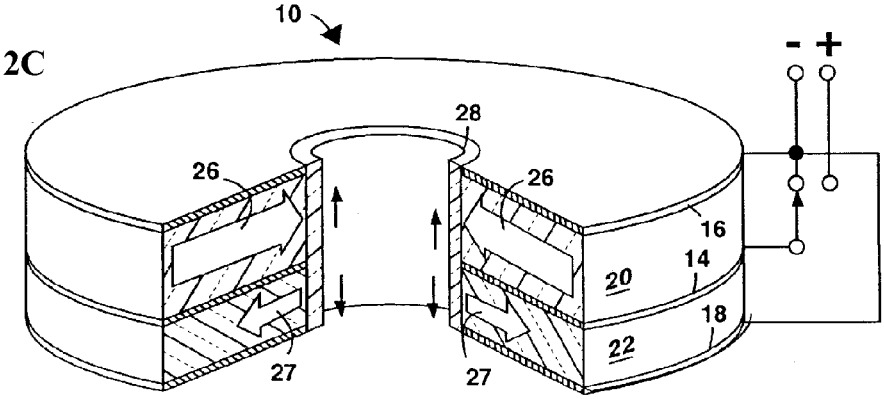
Figure 2D:
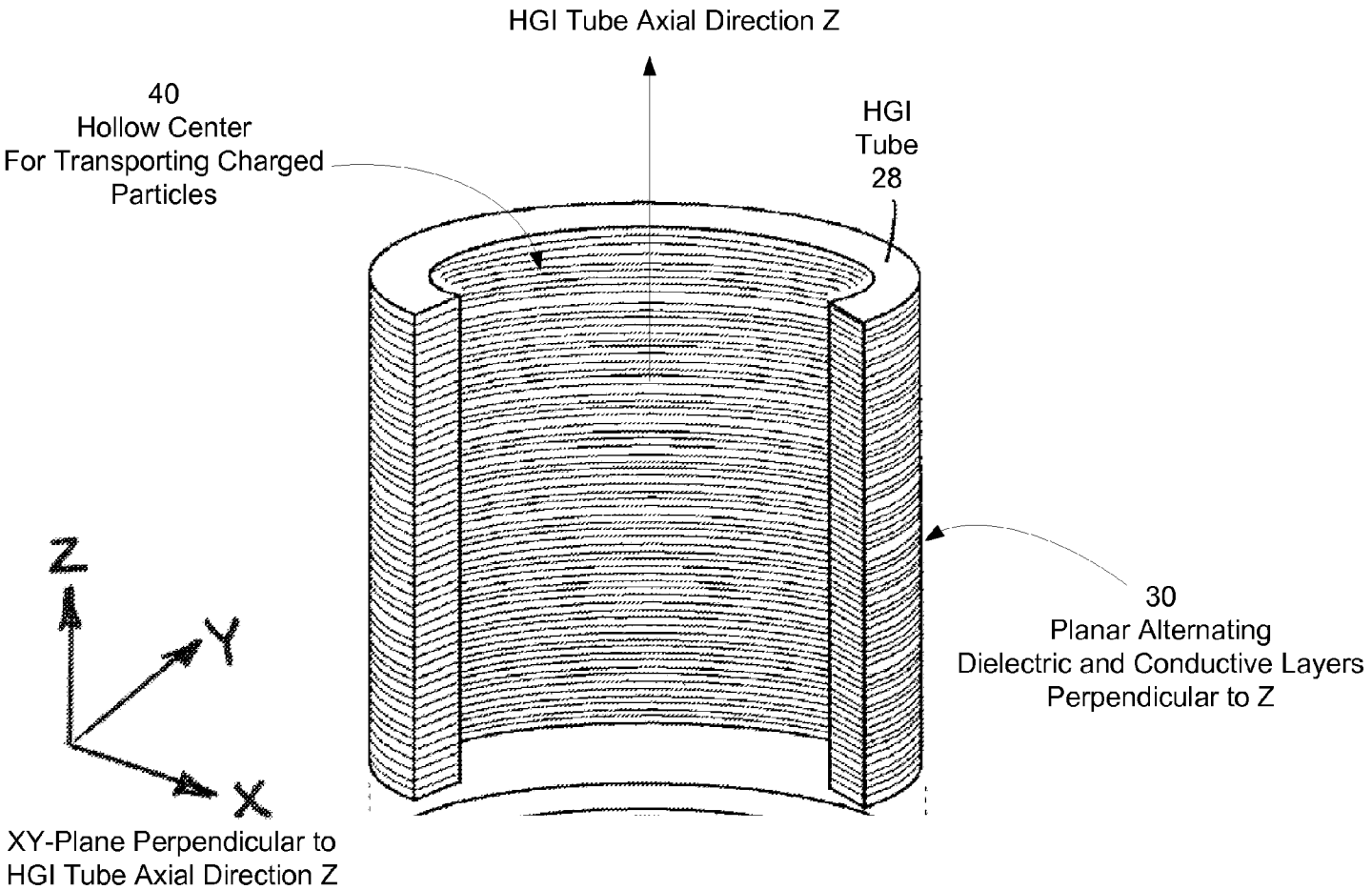

FIG. 2A, FIG. 2B, FIG. 2C and FIG. 2D provide exemplary diagrams that illustrate the structure and operation of a single DWA cell 10 that can be utilized with the linac 100 of FIG. 1. FIGS. 2A-2C provide a time-series that is related to the state of a switch 12. As shown in FIGS. 2A-2C, a sleeve 28 fabricated from a dielectric material is molded or otherwise formed on the inner diameter of the single accelerator cell 10 to provide a dielectric wall of an acceleration tube. FIG. 2D shows an example of the dielectric sleeve 28 of the DWA in a high gradient insulator (HGI) structure, which is a layered insulator 30 having alternating electrically conductive materials (e.g., metal conductors) and dielectric materials. The HGI structure 30 in this example is made of alternating dielectric and conductive disk layers to form a HGI tube with a hollow center 40 for transporting the charged particles. This HGI structure is capable of withstanding high voltages generated by the Blumlein devices and, therefore, provides a suitable dielectric wall of the accelerator tube. The charged particle beam is introduced at one end of the accelerator tube for acceleration along the central axis of the HGI tube.

As shown in FIGS. 2A, 2B and 2C, the switch 12 and conductive transmission lines 16, 14 and 18 are connected to the HGI tube 28 to allow the middle transmission line 14 to be charged by a high voltage source. The conductive transmission lines 16, 14 and 18 are shown as conductive rings or plates in this specific example, but can be alternatively implemented in various transmission line geometries other than the rings or plates. Each of the conductive transmission lines 16, 14 and 18 is in electrical contact with a respective conductive layer of the alternating conductive and dielectric layers in the HGI tube 28. A laminated dielectric 20 with a relatively high dielectric constant separates the conductive plates 14 and 16 and forms the top half of the DWA cell 10 with the conductive plates 14 and 16. A laminated dielectric 22 with a relatively low dielectric constant separates the conductive plates 14 and 18 and forms the bottom half of the DWA cell 10 with the conductive plates 14 and 18. In the exemplary diagram of FIGS. 2A-2C, the middle conductive plate 14 is set closer in distance to the bottom conductive plate 18 than to the top conductive plate 16, such that the combination of the different spacing and the different dielectric constants results in the same characteristic impedance on both sides of the middle conductive plate 14. Although the characteristic impedance may be the same on both halves, the propagation velocity of signals through each half is not the same. The propagation velocity of an applied signal in the higher dielectric constant half with laminated dielectric 20 is slower. This difference in relative propagation velocities is represented by a short fat arrow 24 and a long thin arrow 25 in FIG. 2B, and by a long fat arrow 26 and a reflected short thin arrow 27 in FIG. 2C. In some systems, the Blumleins comprise a linear-folded arrangement with the same dielectric on both halves and different lengths from switch to gap.

In a first position of the switch 12, as shown in FIG. 2A, both halves are oppositely charged so that there is no net voltage along the inner length of the assembly. After the lines have been fully charged, the switch 12 closes across the outside of both lines at the outer diameter of the single accelerator cell, as shown in FIG. 2B. This causes an inward propagation of the voltage waves 24 and 25 which carry opposite polarity to the original charge such that a zero net voltage will be left behind in the wake of each wave. When the fast wave 25 hits the inner diameter of its line, it reflects back from the open circuit it encounters. Such reflection doubles the voltage amplitude of the wave 25 and causes the polarity of the fast line to reverse. For only an instant moment more, the voltage on the slow line at the inner diameter will still be at the original charge level and polarity. As such, after the wave 25 arrives but before the wave 24 arrives at the inner diameter, the field voltages on the inner ends of both lines are oriented in the same direction and add to one another, as shown in FIG. 2B. Such adding of fields produces an impulse field that can be used to accelerate a beam. The impulse field is neutralized, however, when the slow wave 24 eventually arrives at the inner diameter, and is reflected. This reflection of the slow wave 24 reverses the polarity of the slow line, as is illustrated in FIG. 2C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters.

Multiple DWA cells 10 may be stacked or otherwise arranged over a continuous dielectric wall, to accelerate the proton beam using various acceleration methods. For example, multiple DWA cells may be stacked and configured to produce together a single voltage pulse for single-stage acceleration. In another example, multiple DWA cells may be sequentially arranged and configured for multi-stage acceleration, wherein the DWA cells independently and sequentially generate an appropriate voltage pulse. For such multi-stage DWA systems, by appropriately timing the closing of the switches (as illustrated in FIGS. 2A to 2C), the generated electric field on the dielectric wall can be made to move at any desired speed. In particular, such a movement of the electric field can be made synchronous with the charged particle beam pulse that is input to the DWA, thereby accelerating the charged particle beam in a controlled fashion that resembles a traveling wave propagating down the DWA axis. The charged particle beam that travels within the DWA in the above fashion is sometimes referred to a "virtual traveling wave."

To attain the highest accelerating gradient in the DWA, the accelerating voltage pulses that are applied to consecutive sections of the DWA should have the shortest possible duration since the DWA can withstand larger fields for pulses with narrow durations. This can be done by appropriately timing the switches in the transmission lines that feed the continuous HGI tube of the DWA.

Figure 3A:
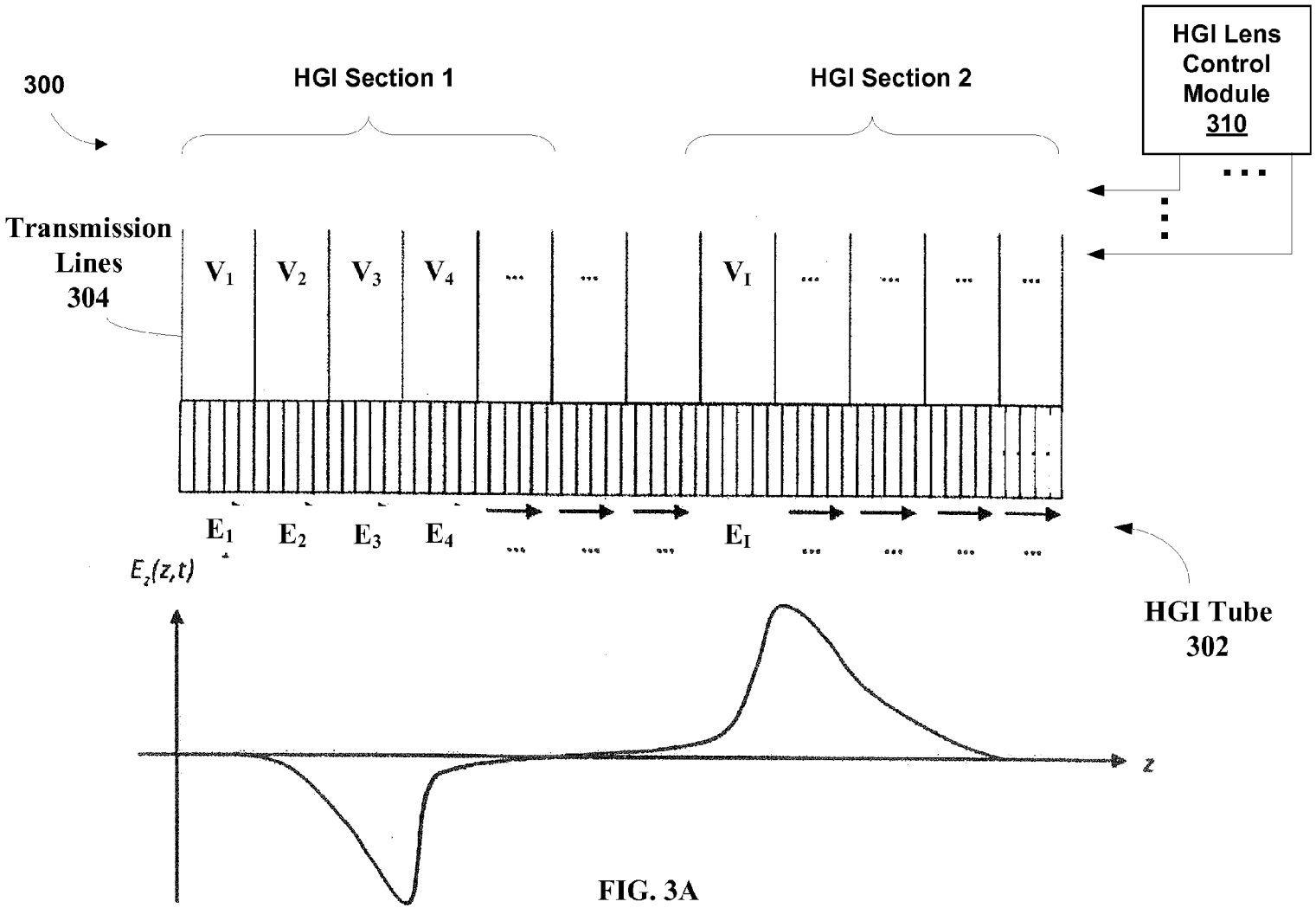
FIG. 3A illustrates a high gradient lens in accordance with an exemplary embodiment of the described technology.

FIG. 3A illustrates an exemplary high gradient lens 300 in accordance with an exemplary embodiment. In the context of the particle beam accelerator 100 that is shown in FIG. 1, the high gradient lens 300 of FIG. 3A can constitute all or some portion of the high gradient lens 118 that is placed in front of the DWA 108. Alternatively, the high gradient lens 300 of FIG. 3A may be used in conjunction with any system that utilizes charged particle beams.

The exemplary high gradient lens 300 of FIG. 3A includes a stack of alternating layers of insulators and conductors with a hollow center that form a high gradient insulator (HGI) tube 302, represented by a cross-section of an upper wall of the HGI tube. As shown in FIG. 3A, the HGI tube 302 may include two or more identical or similarly constructed HGI tubular sections, such as HGI section 1 and HGI section 2 as illustrated in the specific example. Various HGI section configurations can be implemented. Different from the DWA, the HGI tube 302 is operated by a HGI lens control module 310 as a charged particle lens that produces an axial electric field profile along the HGI tube 302 to generate a radial direction electric field distribution that achieves a desired beam focusing or defocusing operation on an incoming charged particle beam. The HGI lens control module 310 produces and applies control voltage pulses $V_1, V_2, \ldots, V_I$ to the HGI tube 302 by a series of transmission lines 304. In one example embodiment, thickness of the transmission lines 304 is in the order of a few millimeters. The electric field generated by the HGI tube 302 has both an azimuthal or axial component along the HGI tube 302 that can accelerate or decelerate the charged particle beam and a radial component perpendicular to the HGI tube 302 that focuses or defocuses the charged particle beam.

In the examples in FIG. 3A and some other drawings, the HGI tube 302 has a geometry where the alternating dielectric and conductive layers are planar layers substantially perpendicular to the axial axis of the HGI tube 302 to produce an electric field that has both an axial components along the HGI tube 302 that can accelerate or decelerate the charged particle beam and a radial component perpendicular to the HGI tube 302 that can focus or defocus the charged particle beam. FIG. 2D further shows this geometry of the HGI geometry in FIG. 3A where the axial direction of the HGI tube 302 is along the z direction and the alternating dielectric and conductive layers are planar layers in the xy plane. In other designs, the HGI dielectric and conductive layers in the HGI tube 302 can be configured so that the alternating dielectric and conductive layers are either planar layers that are slanted relative to the axial axis of the HGI tube 302 or are wavy or curved layers that create complex electric field profiles (e.g., dipole or quadrupole electric fields) that include axial accelerating/decelerating field, multi-pole field components defined by the conductor layers, and focusing/defocusing radial fields determined by the axial electric field profile.

Figure 3B:
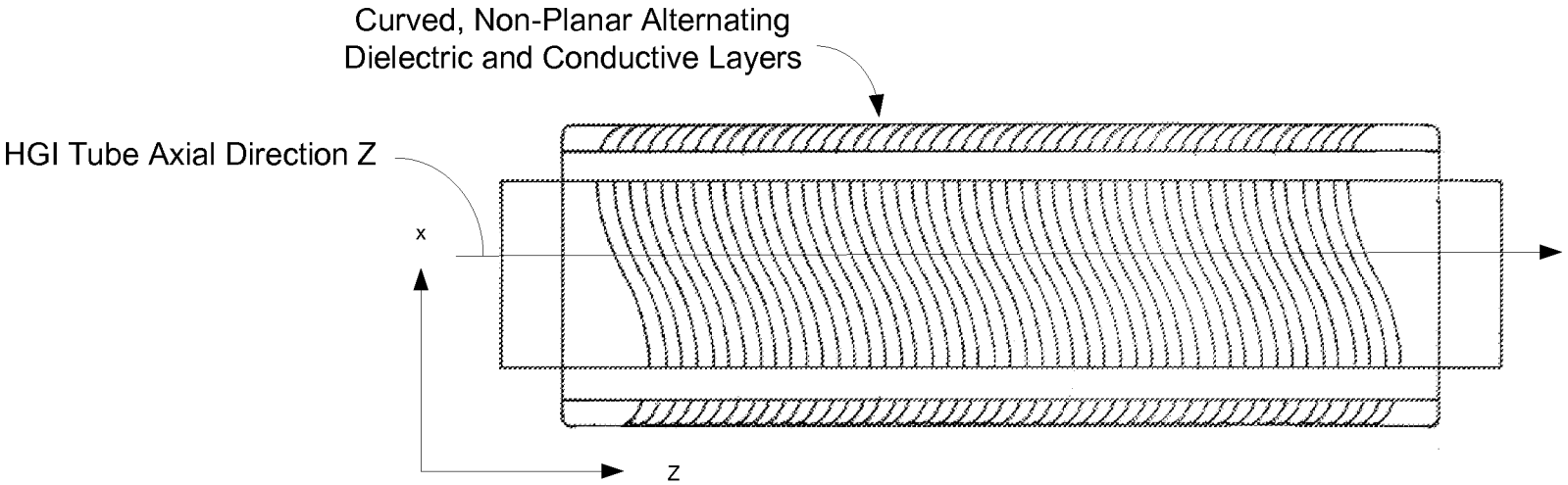
FIGS. 3B, 3C and 3D illustrate examples of the HGI tube having alternating dielectric and conductive layers that are either planar layers slanted relative to the axial axis of the HGI tube or are wavy or curved layers.
Figure 3C:
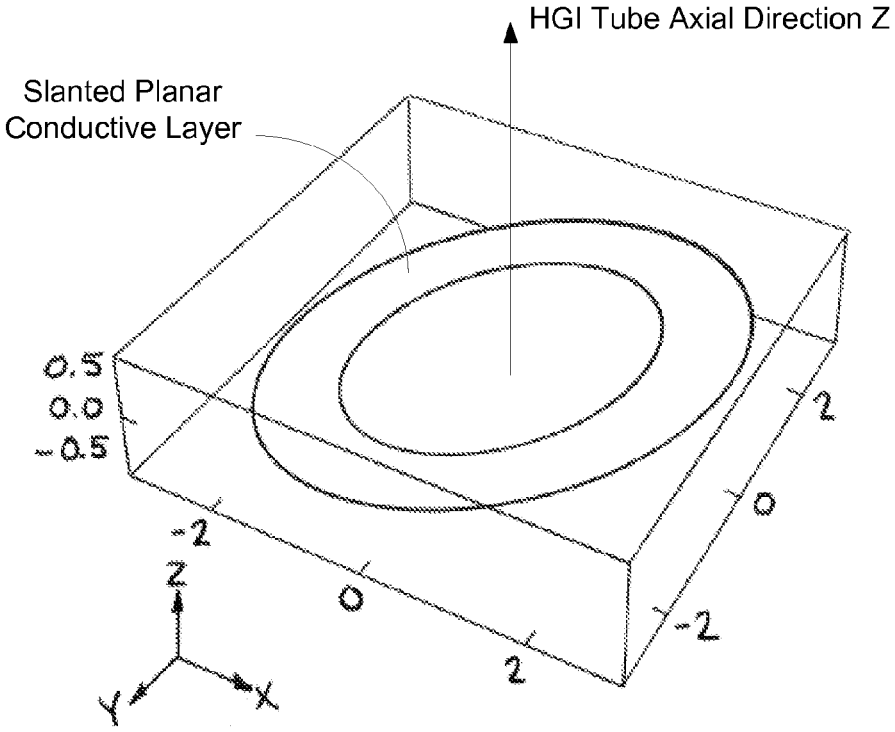
Figure 3D:
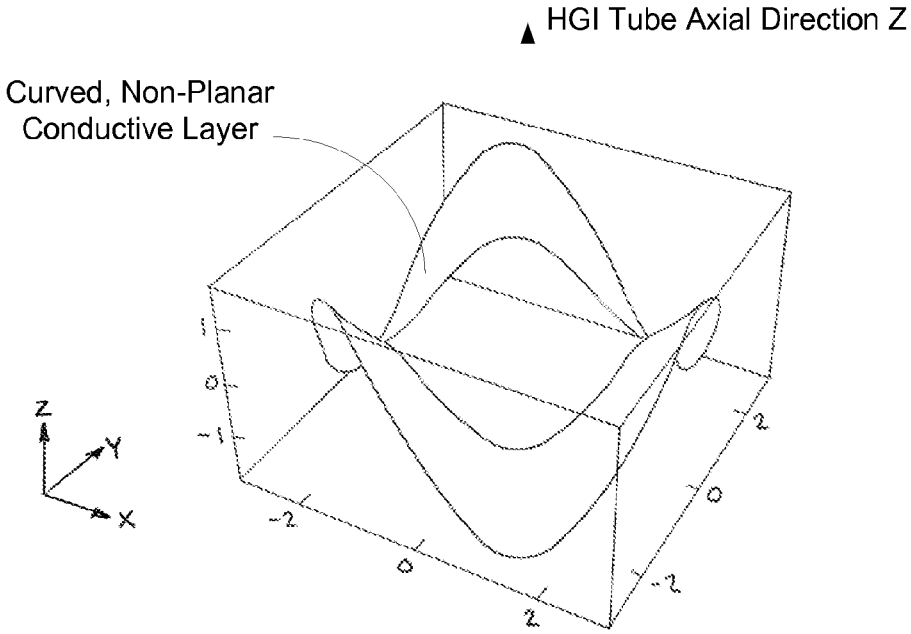

FIG. 3B shows an example of a HGI tube that has curved, non-planar alternating dielectric and conductive layers that are no longer perpendicular to the axial direction (z) of the HGI tube. FIG. 3C shows a slanted planar conductive layer for an example of HGI alternating dielectric and conductive layers that are planar but are slanted at a non-90 degree angle with respect to the z axis. Such conductive slated planar layers tend to produce a dipole electric field profile. FIG. 3D shows a curved, non-planar conductive layer for an example of HGI alternating dielectric and conductive layers that are curved to produce complex electric fields such as a quadrupole field. Various alternating dielectric and conductive layers that are either planar layers slanted relative to the axial axis of the HGI tube or are wavy or curved layers can be used to create complex electric field profiles to achieve beam focusing and manipulation operations that may be difficult to achieve with perpendicular planar alternating dielectric and conductive layers shown in FIGS. 2D and 3A.

In some embodiments, each transmission line 304 can be charged by its own dedicated charging system as part of the HGI lens control module 310, whereas in other embodiments, several transmission lines 304 can form a block that is charged by a common charging system as part of the HGI lens control module 310. Each of the voltages $V_1, V_2, \ldots, V_I$ produces an associated electric field $E_1, E_2, \ldots, E_I$ in the corresponding section of the HGI tube 302. Each electric field and corresponding voltage may also be associated with a different HGI section, up to an $I^{th}$ HGI section. In accordance with the disclosed embodiments, by varying the transmission lines' 304 voltages $V_1, V_2, \ldots, V_I$ from one section (e.g., HGI section 1) to the next section (e.g., HGI section 2) of the HGI tube 302, a variation of both the electric field gradient or intensity, and the electric field profile is effectuated. Such a configuration provides great flexibility to dynamically shape the on-axis accelerating electric field's longitudinal profile $E_z(z,t)$ along the HGI tube 302 and its corresponding radial electric field. The bottom portion of FIG. 3A, illustrates an exemplary longitudinal electric filed profile $E_z(z,t)$ that can be produced by the exemplary high gradient lens 300. The longitudinal electric field profile in FIG. 3A is provided as one example of myriad electric fields that can be established across the HGI tube 302 in response to the voltage values that are applied to the different sections of the HGI tube 302.

As discussed in detail in the sections that follow, the lens designs in this patent document can be configured to provide the desirable adjustable electric field profile by varying the control voltages applied to the HGI sectors and can adjust the electric field profile of the lens at a given lens location or within a range of permissible lens locations to achieve the desired focusing or defocusing of the charged particle beam. In particular, the exemplary high gradient lens 300 of FIG. 3A can be configured to operate as, for example, a focusing lens for a charged particle beam, as a defocusing lens for a charged particle beam, to provide acceleration and/or deceleration for a charged particle beam, operate as both a focusing and defocusing lens (e.g., an Einzel lens configuration), provide rapid and dynamic change in the spot size of the particle beam that travels through the HGI tube 302, and more generally, to allow shaping of the charged particle beam as desired. For example, in one embodiment, the high gradient lens can be configured to operate as a strong linear (or substantially linear) lens with very little aberrations, whereas in another embodiment, the high gradient lens 300 can be configured to operation as a highly non-linear lens. In still other example embodiments, the high gradient lens can be used produce a desired set of output beam characteristics. For example, the high gradient lens 300 can be configured to correct non-uniformities in an input beam. Moreover, two or more high gradient lenses 300 can configured to operate together as, for example, a focusing lattice.

The above noted features of the high gradient lens 300 that is described in the disclosed embodiments provide significant improvements over various other lenses that are used for transporting charged particle beams. In implementations of some other charged particle systems that utilize either magnetic lenses or electrostatic lenses, the profile of the associated electric/magnetic fields tends to be fixed by the lens geometry and shaping of the electric/magnetic fields for the desired aberrations (such as spherical aberration) cannot be readily obtained. For instance, with a magnetic lens, shaping of the field profile is accomplished by winding of the magnet's wires and/or the magnet's pole surface. Both of these methods have severe limitations since, for example, they require changes in the physical shape and construction of the magnetic lens. Further, the magnetic lens' field strength may be difficult to be changed rapidly, and magnetic lenses often cannot be used for accelerating or decelerating charged particle beams. As a result, the addition of magnetic lenses for charged particle beam transport tends to create longer accelerator systems and produces a lower average accelerator gradient.

Various electrostatic lens designs achieve shaping of the electric field profile by shaping the surface/shape of the lens' electrodes. However, in such a lens, the breakdown limit of the electrodes and the nearby insulators can severely limit shaping of the electric field. Therefore, such electrostatic lenses based on shapes of electrodes tend to be only used for low energy beam transport in the range of, for example, several keV or 1 MeV and can be less effective as lenses for operating on high energy beams.

Moreover, for magnetic lenses or electrostatic lenses, once the lens is manufactured, its electric field profile is usually fixed and cannot be dynamically controlled or varied. Since the electric field profile dictates the lensing operation of such a lens, such a lens is usually specifically designed and made for operation at a particular beam location and for modifying a particular input beam profile at that beam location in order to produce a particular desired output beam profile. If the input beam profile deviates from the particular input beam profile for which the lens is designed, the lens cannot be operated at the given beam location to produce the desired output beam profile. In such a situation, either the lens position or the lens design or both may need to be adjusted to achieve the desired lens operation. In various charged particle systems, the location of the lens tends to be restricted to certain locations. Therefore, this lack of adjustable electric field profile in magnetic lenses, electrostatic lenses or other lenses for charged particles significantly limits utility of a particular lens in applications.

The ability of producing adjustable electric field profile in the charged particle lens designs of this patent document can be used to achieve various functionalities and address various technical needs. For example, the charged particle lens designs of this patent document can be implemented to meet the need for an accelerator to focus the charged particle beam while accelerating the particles and to provide both strong focusing field and high accelerating gradient without degrading accelerator's averaged accelerating gradient. Most applications require the transport of the charged particle beam through a distance and often require the delivery of the beam to a tight spot at the target location. Sometimes, there is a sizable energy slope on those beams, such as in applications related to charged particle beams in a heavy ion fusion machine. In these and other applications, the charged particle lens designs of this patent document can be used to provide a strong lens capable of providing dynamic variation in focal length and field profile is highly desirable. In some applications, such as in intensity modulated proton therapy (IMPT), intensity modulated radiation therapy (IMRT), etc., the beam spot size is required to rapidly (e.g., during a single treatment) vary from a tight spot to a large spot at the target location from shot to shot and the charged particle lens designs of this patent document can be used to provide such pulse-to-pulse focal length and field profile variation.

To facilitate the understanding of the disclosed embodiments, it is instructive to analyze the longitudinal electric field along the z-axis as a function of time, t, as give by Equation (1) below.

$$E_Z(z, t) = \tilde{E}(z) f\left(t - \int_{Z0}^{Z} \frac{dz'}{v}\right). \quad (1)$$

In Equation (1), $\tilde{E}(z)$ is the field gradient of the electric field and $$f\left(t - \int_{Z0}^{Z} \frac{dz'}{v}\right)$$

describes the electric field's waveform and its field package moving down the z-axis with velocity, v. With $\nabla \cdot \vec{E}=0$, the corresponding radial electric field at a radial position, r, within the HGI tube, is much less than $$\frac{E_Z}{\left|\frac{\partial E_Z}{\partial z}\right|},$$

is given by Equation (2).

$$E_r(z, t) \approx -\frac{r}{2} \frac{\partial E_Z(z, t)}{\partial z}. \quad (2)$$

It should be noted that if $$\frac{\partial E_Z(z, t)}{\partial z}$$

is constant the high gradient lens is a perfectly linear lens. It is understood that, in practical implementations, it is often not feasible to produce a perfectly linear longitudinal electric field variation. Therefore, a substantially linear lens is often produced. Combining Equations (1) and (2) produces the following expression for the radial electric field.

$$E_r(z, t) \approx -\frac{r}{2}\left[\tilde{E}'(z) f(z - vt) + \tilde{E}(z) \frac{df}{dt} \Big/ v\right]. \quad (3)$$

In Equation (3), the term $\tilde{E}'(z)$, represents the derivative of $\tilde{E}(z)$ with respect to z. Depending on the relative position of the charged particle beam that is propagating in the HGI tube with respect to the peak of the electric field waveform, the second term on the right hand side of Equation (3) provides a radial focusing or defocusing field. In applications that utilize short pulses, the high gradient lens can operate as a focusing lens and defocusing lens simply by controlling the timing of the charged particle bunch with respect to the accelerating wave.

Examination of Equation (3) reveals that an additional radial electric field control capability can be implemented through the first term on the right hand side of Equation (3). To this end, in some embodiments, the control of the radial electric field is effectuated by varying the voltages that are applied to one or more sections of the high gradient lens. By dynamically adjusting the charging voltages of the individual transmission line, or a block of transmission lines, the longitudinal electric field profile can be shaped to produce a specific net radial electric field. Such a control over the electric field profile and radial electric field can be implemented for each charged particle beam bunch (i.e., on a shot-by-shot or a pulse-by-pulse basis) that traverses the HGI tube of the high gradient lens. The characteristic of the high gradient insulators allows them to withstand electric fields that are three to four times higher than the conventional insulators. Therefore, the longitudinal electric field of the high gradient lens can be ramped up or down rapidly along the lens' z-axis to at least three to four times of the maximum field gradient on a conventional electric lens without breakdown, and hence the focusing strength of a HGI lens is three to four times stronger than a conventional electrical lens.

It should be further noted that, to facilitate the understanding of the disclosed embodiments, Equations (2) to (4) have been presented to include a radial electric field based on the simplified assumption that the transverse electric field is radially symmetric. However, the disclosed embodiments are also applicable to transverse electric field that is not radially symmetric. In those cases, the transverse electric field includes both x- and y-components.

To further illustrate the focusing capability that can be obtained from the first term on the right hand side of Equation (3), let us consider the special case in which the charged particle bunch is riding either on the crest or on the flattop of the electric pulse, or that the accelerating wave package is not traveling so that the second term in Equation (3) is zero. Under such assumptions, the charged particle beam's root-mean-square (r.m.s.) beam envelope, R, can be characterized by the following equation.

$$R'' + \frac{(\gamma\beta)'}{\gamma\beta} R' = -\frac{q\tilde{E}'}{2\gamma\beta^2 mc^2} R + \frac{\frac{I}{I_0}}{\gamma^3\beta^3 R} + \frac{\varepsilon_n^2}{\gamma^2\beta^2 R^3}. \quad (4)$$

In Equation (4), $\gamma$ is the Lorentz factor, c is the speed of light, $\beta$=v/c, q is the charged particle's charge, m is the charged particle's mass, I is the charged particle beam's current, $I_0$ is the charged particle beam's Alfven current, and $\in_n$ is the charged particle beam's normalized r.m.s. emittance. Equation (4) can be used to evaluate and analyze the r.m.s. beam envelop, as will be discussed in connection with FIGS. 5 and 9.

The high gradient lens that is described in this patent document (e.g., the high gradient lens 300 of FIG. 3A) can be configured to provide acceleration and focusing for a positively charged particle beam (such as a proton beam) in accordance with the disclosed embodiments. Such a high gradient lens can be configured to establish various electric field profiles, e.g., a positive valued radial electric field to focus a positively charged particle beam; a positive valued radial electric field to defocus a negatively charged particle beam; a negative valued radial electric field to focus a negatively charged particle beam; or a negative valued radial electric field to defocus a positively charged particle beam.

Figure 4:
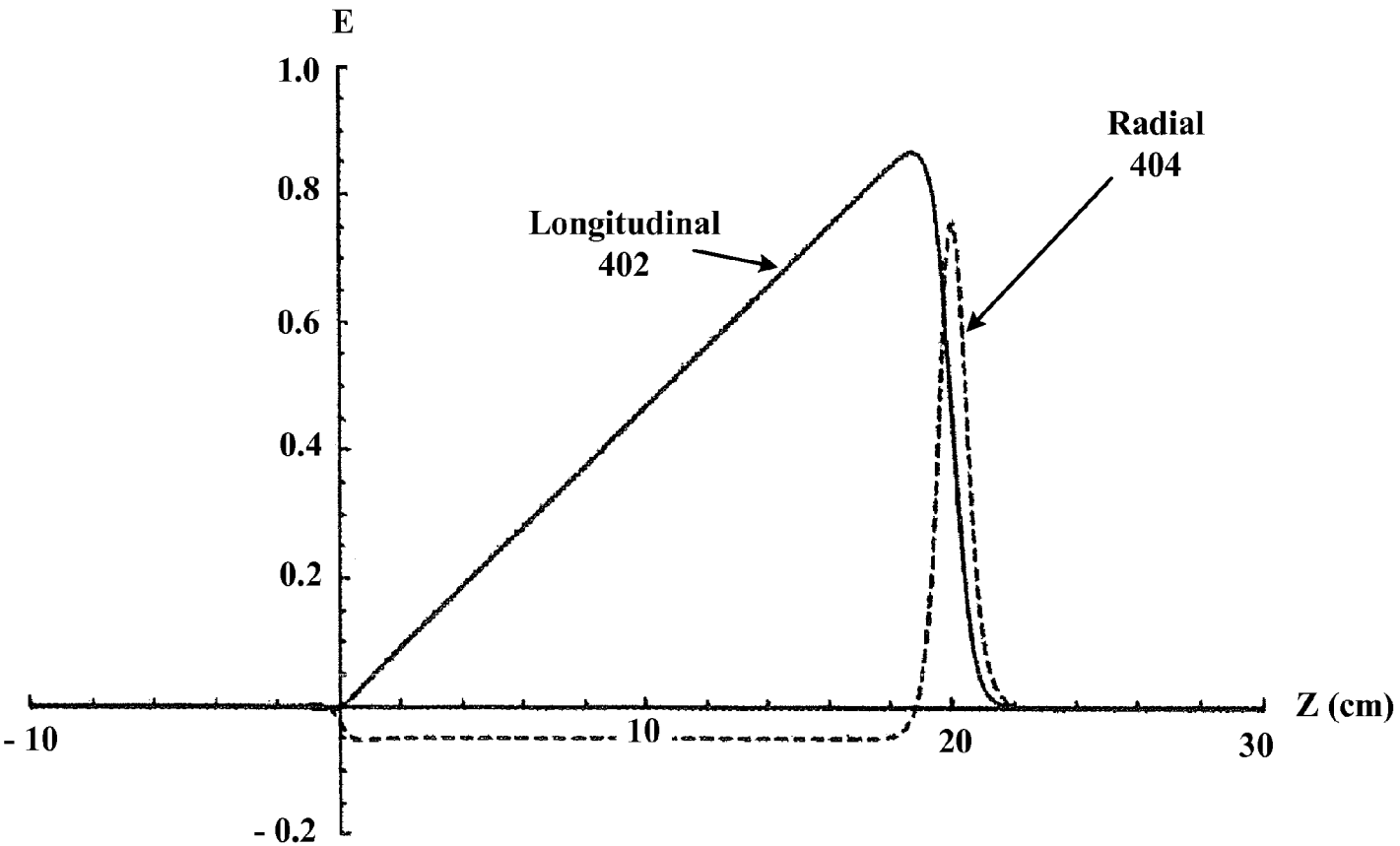
FIG. 4 is a plot of longitudinal and radial electric fields produced in accordance with an exemplary embodiment of the described technology.

FIG. 4 illustrates an example of the longitudinal 402 and radial 404 electric fields as a function of distance along the z-axis that is produced by applying voltages to a 20-cm long high gradient lens, such as the high gradient lens 300 of FIG. 3A. The electric fields that are illustrated in FIG. 4 accelerate and focus a positively charged particle beam that traverses through the high gradient lens. Similarly, the exemplary electric fields that are illustrated in FIG. 4 operate to decelerate and defocus a negatively charged particle beam that propagates through the high gradient lens. Such electric fields can be established across a high gradient lens that is, for example, inserted in front of a DWA as part of the high gradient lens 118 that is illustrated in FIG. 1.

In one exemplary configuration, the longitudinal electric field associated with a 20-cm long high gradient lens is ramped up linearly at 0.047 MV/cm$^2$, and a 2 MeV, 200 mA, 0.9 cm, 1-mm-mrad proton beam is injected into the system. Upon traversing through the high gradient lens, the proton beam enters an exemplary 180-cm long DWA with a constant gradient of 96 MeV/m.

Figure 5:
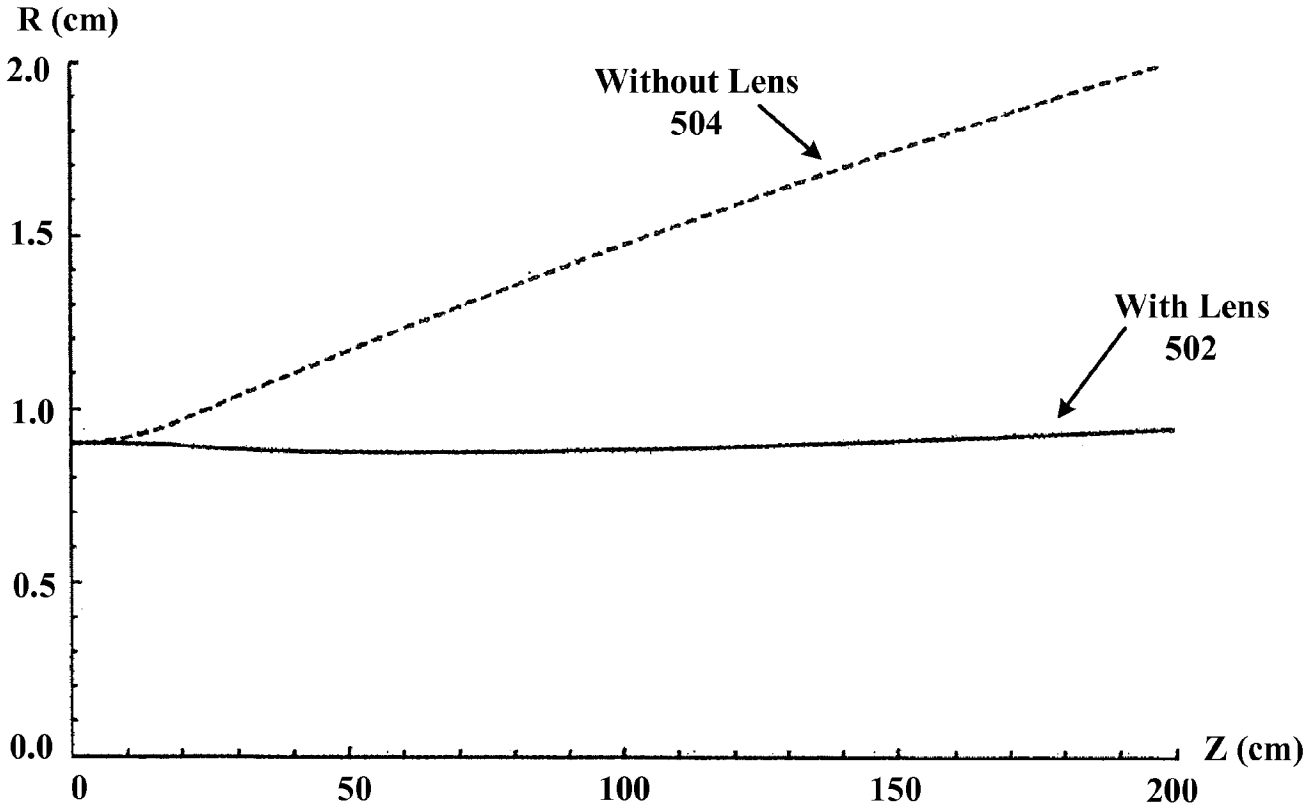
FIG. 5 is a plot of a charged particle beam's radius that is produced in accordance with an exemplary embodiment of the described technology.

FIG. 5 shows the root-mean-square (r.m.s.) envelope for the above described exemplary proton beam under the control of the high gradient lens. The solid line 502 in FIG. 5 illustrates the r.m.s. envelope of the proton beam along the z-axis at the output of a 180-cm DWA, when a 20-cm high gradient lens is used at the input side of the DWA. The dotted line 504 in FIG. 5 corresponds to the r.m.s. envelope for a proton beam in the absence of the high gradient lens, where the proton beam has been accelerated in the accelerator with a slightly higher gradient to produce the same energy as would be achieved by using the high gradient lens.

Comparison of the two envelopes in FIG. 5 reveals that by using a single 20-cm long high gradient lens in combination with the DWA, the transport of the proton beam through the DWA is accomplished with a nearly constant envelope, whereas in the absence of such a lens, the transported particle beam would have had a significantly larger r.m.s. beam envelope. It should be noted that while the exemplary plot of FIG. 5 shows that by utilizing the high gradient lens a nearly constant beam envelop can be obtained, high gradient lens can be configured to produce other beam envelopes by controlling the applied voltages.

Figure 6:
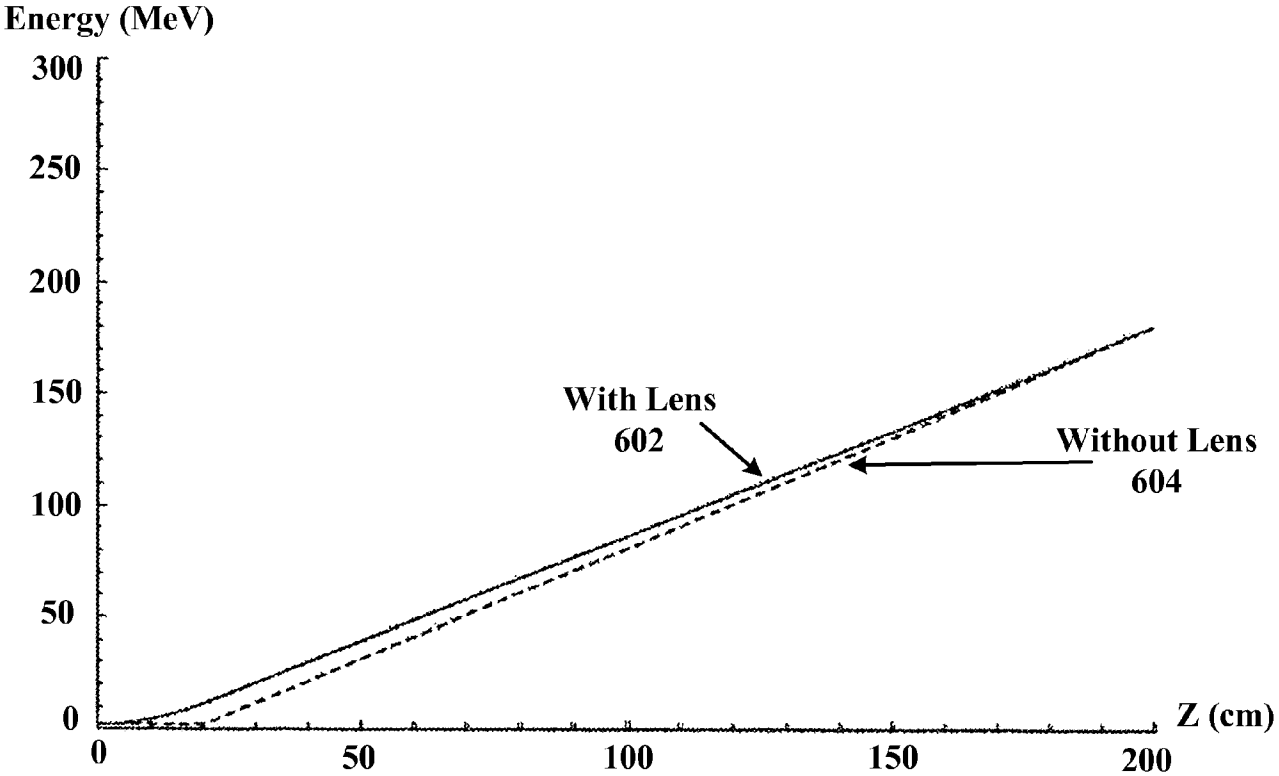
FIG. 6 is a plot of a charged particle beam's energy that is produced in accordance with an exemplary embodiment of the described technology.

FIG. 6 shows an example of the energy profiles of the charged particle beam for the same configuration that was used in FIG. 5, where the solid line 602 corresponds to energy of the beam as it travels through the above accelerator system that includes a high gradient lens, whereas the dotted line 604 illustrates the energy profile of the proton beam without the high gradient lens. The plots in FIG. 6 illustrate that the beams in the two configurations have substantially the same energy profile.

The high gradient lens that is described in, for example, FIG. 3A can also be configured to provide deceleration and defocusing for a positively charged particle beam (such as a proton beam) in accordance with the disclosed embodiments.

Figure 7:
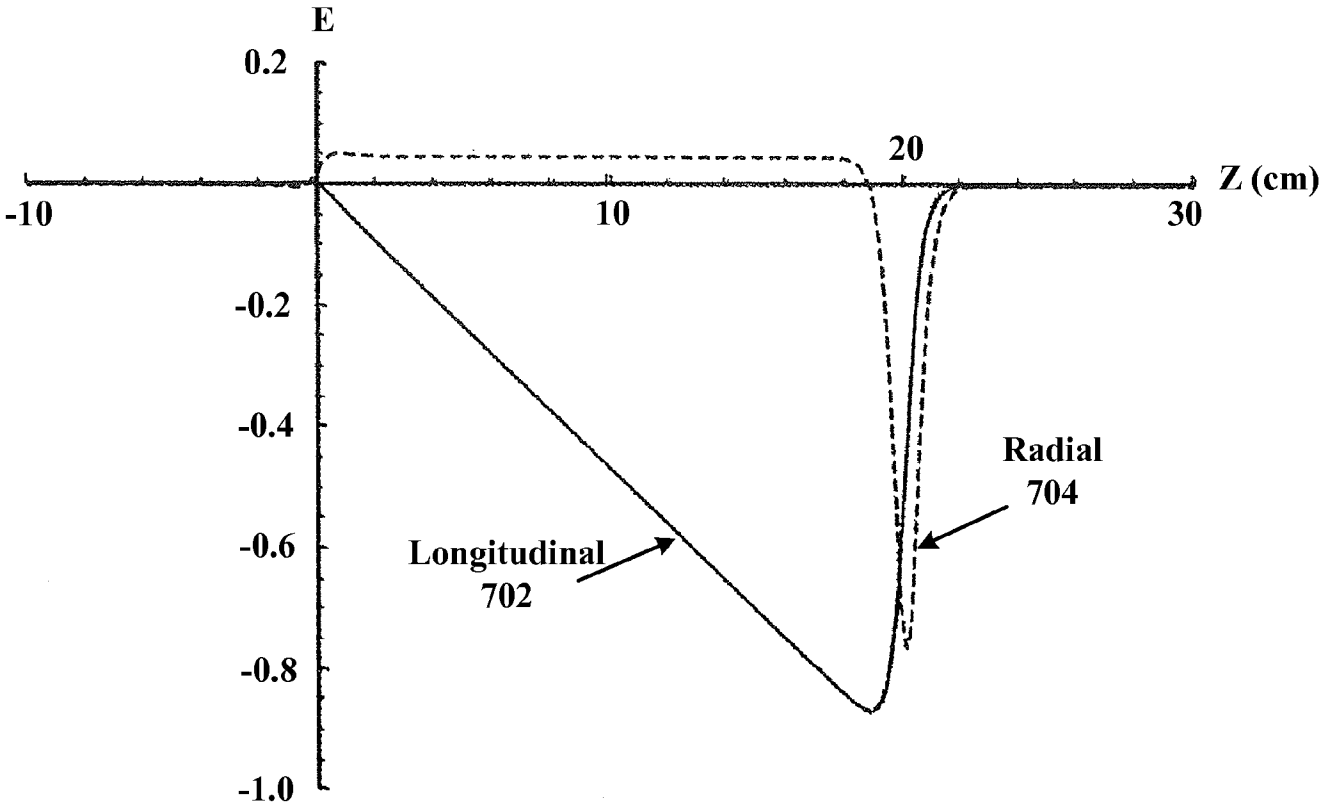
FIG. 7 is a plot of longitudinal and radial electric fields produced in accordance with another exemplary embodiment of the described technology.

FIG. 7 illustrates the longitudinal 702 and radial 704 electric fields as a function of distance along the z-axis that is produced by applying voltages to a 20-cm long high gradient lens, such as the high gradient lens 300 of FIG. 3A. The electric fields that are illustrated in FIG. 7 have the opposite polarity of the electric fields that are depicted in FIG. 4 and, as such, they decelerate and defocus a positively charged particle beam that traverses through the high gradient lens. Similarly, the exemplary electric fields that are illustrated in FIG. 7 operate to accelerate and focus a negatively charged particle beam that propagates through the high gradient lens. Such electric fields can be established across a high gradient lens that is, for example, inserted in front of a proton accelerator as part of the high gradient lens 118 that is illustrated in FIG. 1.

Figure 8:
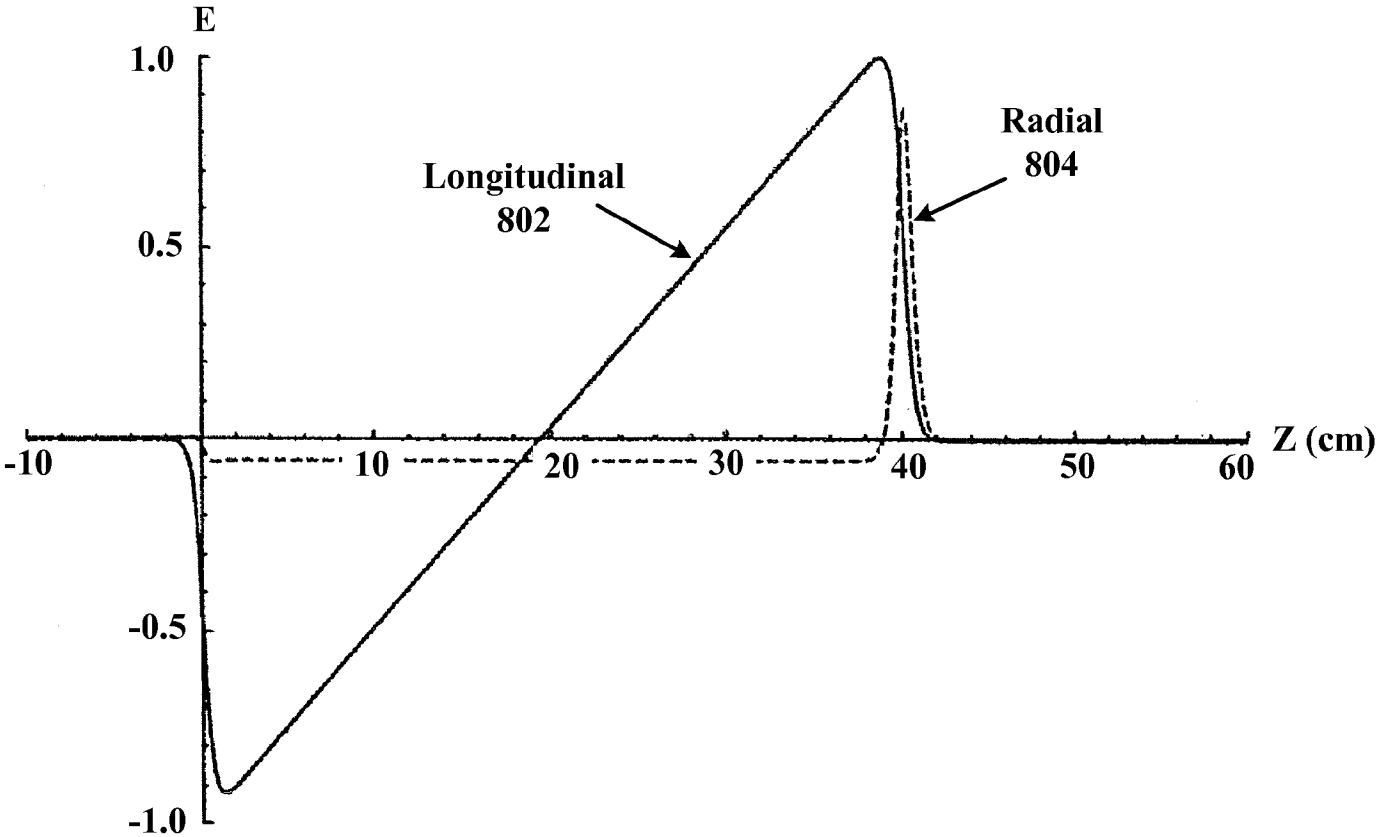
FIG. 8 is a plot of longitudinal and radial electric fields produced in accordance with another exemplary embodiment of the described technology.

The high gradient lens that is described in, for example, FIG. 3A can be further configured to operate as an Einzel lens, which provides focusing/defocusing of the charged particle beam without changing the energy of the beam. In one example embodiment, the high gradient lens is configured to produce longitudinal and radial electric fields associated with an Einzel lens as depicted in FIG. 8, which is a combination of the electric fields that were depicted in FIGS. 3 and 7. The solid line 802 represents the longitudinal electric field and the dotted line 804 represents the radial electric field as a function of the distance along the HGI tube axis, z.

Figure 9:
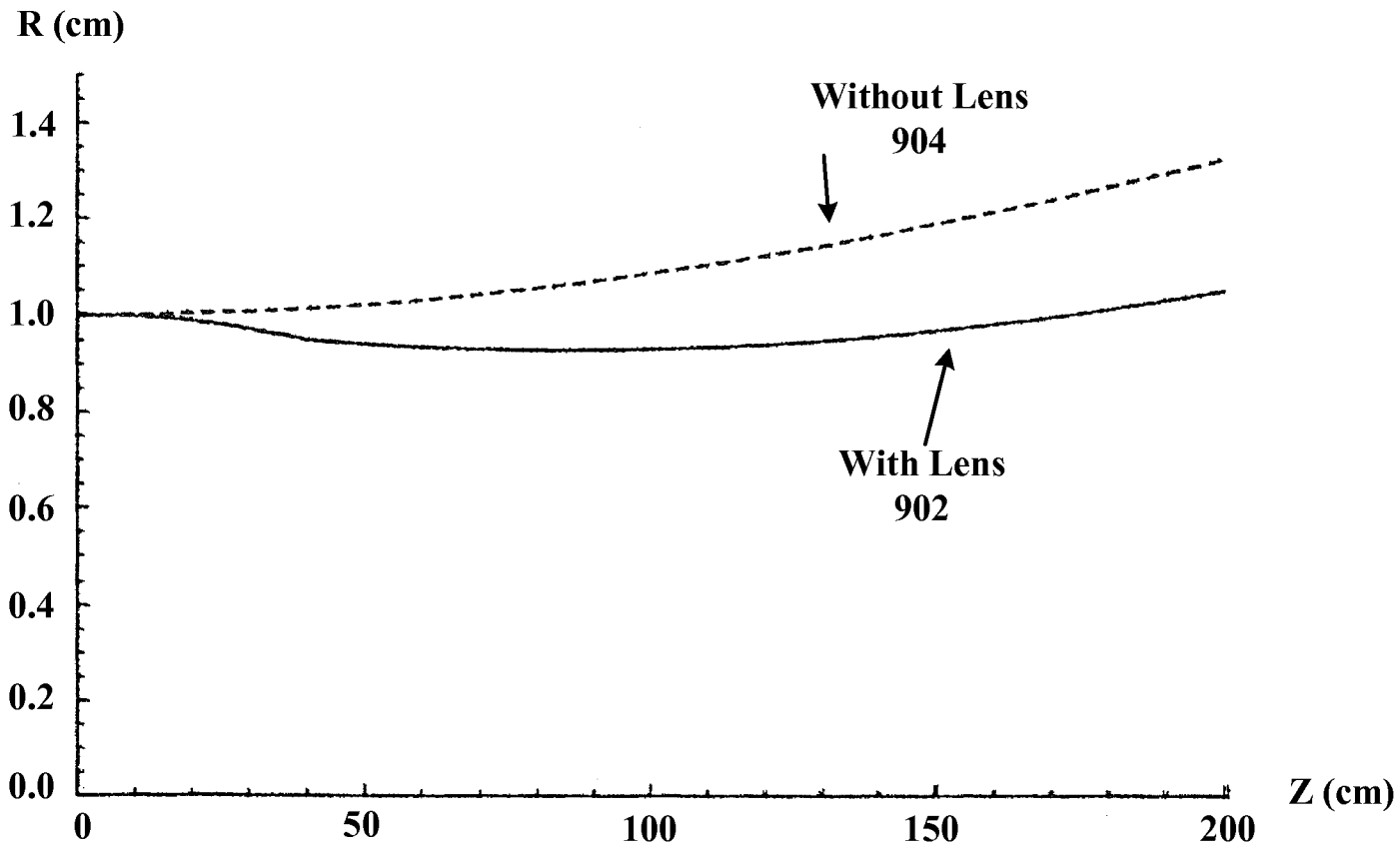
FIG. 9 is a plot of a charged particle beam's radius that is produced in accordance with another exemplary embodiment of the described technology.

The r.m.s. envelope for a proton beam that is subject to the electric field of FIG. 8 plotted in FIG. 9. The solid line 902 in FIG. 9 illustrates the r.m.s. envelope of a proton beam (a 50 MeV, 10-A, 1 mm-mrad beam) along the z-axis at the output of a 180-cm DWA, when a 20-cm high gradient lens is used. The linear ramp of the longitudinal electric field of the high gradient lens is 0.052 MV/cm$^2$. The dotted line 904 in FIG. 9 illustrates the r.m.s. envelope for a proton beam in the absence of the high gradient lens, where the proton beam has been accelerated in the accelerator with a slightly higher gradient to produce the same energy as would be achieved by using the high gradient lens.

FIGS. 4, 7 and 8 provide three examples of the types of longitudinal and radial electric fields that can be established across a high gradient lens in accordance with the disclosed embodiments. A high gradient lens that is described in the this patent document can be configured to dynamically and rapidly focus, defocus, accelerate and/or decelerate the charged particle beam, and/or to vary the spot size, beam energy and/or other characteristics of the charged particle beam. The electric field needed to achieve the desired beam shaping and focusing effects can be established by one or more voltage sources that can be configured to charge all or portions of the high gradient insulator stack of the high gradient lens that are fed by thin transmission lines. Changing the voltages across all or portions of the HGI tube of the high gradient lens allows dynamic control of the longitudinal electric field profile for a desired radial (or transverse) electric field, which can be used to focus/defocus the charged particle beam in a desired fashion. Such a high gradient lens can, for example, be configured to produce any electric field profile for a strong focusing lens, where the quality and strength of the lens can be easily adjusted from shot to shot.

Additionally, or alternatively, the electric field strength along the HGI tube of the high gradient lens can be rapidly changed to vary the focal length, as needed. According to the disclosed embodiments, the high gradient lens can be configured to operate as, for example, a linear lens with very little aberrations (e.g., by configuring the voltage sources to produce a linearly ramped electric field across the HGI tube—see Equation (2)), a highly non-linear lens, a strong Einzel lens, and the like. Such a high gradient lens can be further combined with one or more other lenses for operating on a charged particle beam, including one or more high gradient lenses, to facilitate the transport or manipulation of a charged particle beam. For example, multiple lenses can be used to form a focusing lattice.

Referring back to FIG. 1, the high gradient lens 118 is depicted as a standalone component that is placed in front of the DWA 108. In some embodiments, however, the high gradient lens is incorporated into the DWA to form a single accelerator (as represented by the dashed box in FIG. 1) with additional capabilities of the high gradient lens. The incorporation of the high gradient lens as part of the DWA can reduce the length of the particle accelerator system, simplify manufacturing of the system components, and/or can provide enhanced and adjustable lensing operation for improved performance.

Figure 10:
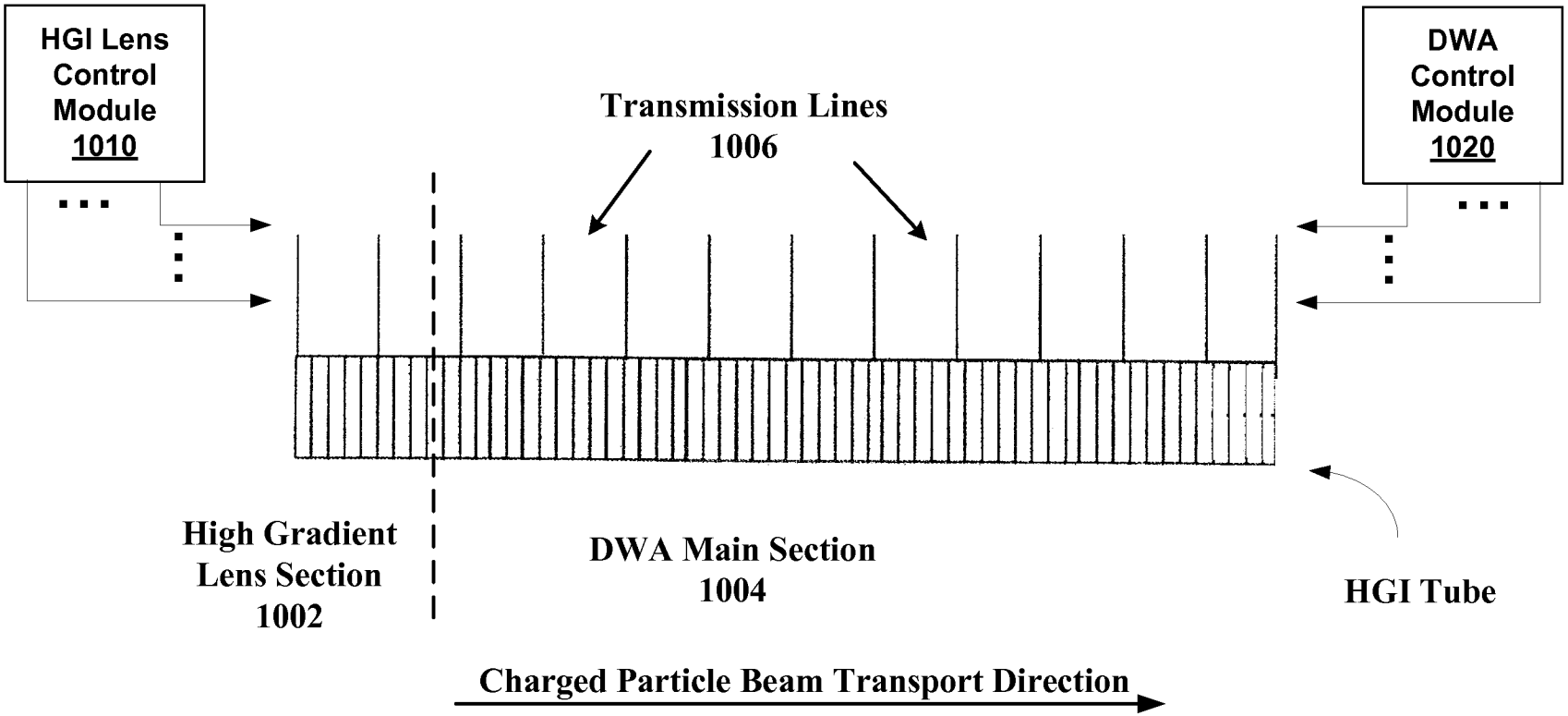
FIG. 10 illustrates a combined high gradient lens and a dielectric wall accelerator configuration in accordance with an exemplary embodiment of the described technology.

FIG. 10 illustrates a combined DWA and high gradient lens configuration in accordance with an exemplary embodiment. The high gradient lens section 1002 in this exemplary embodiment is located at the low energy end, i.e., the input side, of the DWA, followed by the DWA main section 1004 which provides the primary particle acceleration of the system while the HGI lens section 1002 can optionally provide additional acceleration or deceleration of the charged particle beam. The transmission lines 1006 supply voltages from one or more voltage sources to one or more sections of the combined DWA-high gradient lens and are under the control of a timing/control component, which may be implemented as part of the timing and control components 116 that is illustrated in FIG. 1. Alternatively, or additionally, a separate control component may be to control the transmission lines 1006 for one or more sections of the combined DWA-high gradient lens. FIG. 10 shows a HGI lens control module 1010 that supplies and controls the voltages to the HGI lens section 1002 and a separate DWA control module 1020 (e.g., having Blumlein devices) that supplies and controls the voltages to the DWA 1006. In operation, different voltage values can be supplied to each section and/or subsection of the lens-DWA to establish the desired longitudinal and transverse electric fields, which in turn, shapes the charged particle beam bunch as it travels through the HGI tube. As a result, an output beam with any desired characteristic can be produced. These characteristics include, but are not limited to, beam energy, beam spot size, beam slope, beam emittance, beam uniformity, beam intensity and the like. Moreover, the voltages and the corresponding electric fields at one or more sections of the lens-DWA can be modified from shot to shot (i.e., for each charged particle beam bunch that traverses through the HGI tube), thereby modifying the output beam characteristics at, for example, a patient's location dynamically.

Another feature of the high gradient lens that is described in the this patent document is that unlike the charged particle beam that propagates through a DWA, the velocity of the electric field and the travelling particle bunch need not be synchronized in providing the proper beam focusing or defocusing operation. In fact, in one example embodiment, the electric field established across the high gradient lens is static and is not time-varying. In some example embodiments, the established electric field can be changed for each charged particle bunch as a specific application requires. For example, in situations where the beam focusing need be modulated over time, the control voltages can be applied to establish one electric field profile for achieving one beam focusing or defocusing operation at a given time or over a given time period, and subsequently, the control voltages can be changed to establish another, different electric field profile for achieving another, different beam focusing or defocusing operation.

In other configurations, the high gradient lens may be placed downstream (e.g., on the right hand side of FIG. 10) with respect to the DWA. In other configurations, the high gradient lens may be placed anywhere within a particle accelerator system that can benefit from dynamic shaping of the charged particle beams. Moreover, the utilization of the high gradient lens that is described in the this patent document is not limited to particle accelerator systems, but it can rather be used in conjunction with any system that produces, transports or utilizes charged particle beams.

Figure 11:
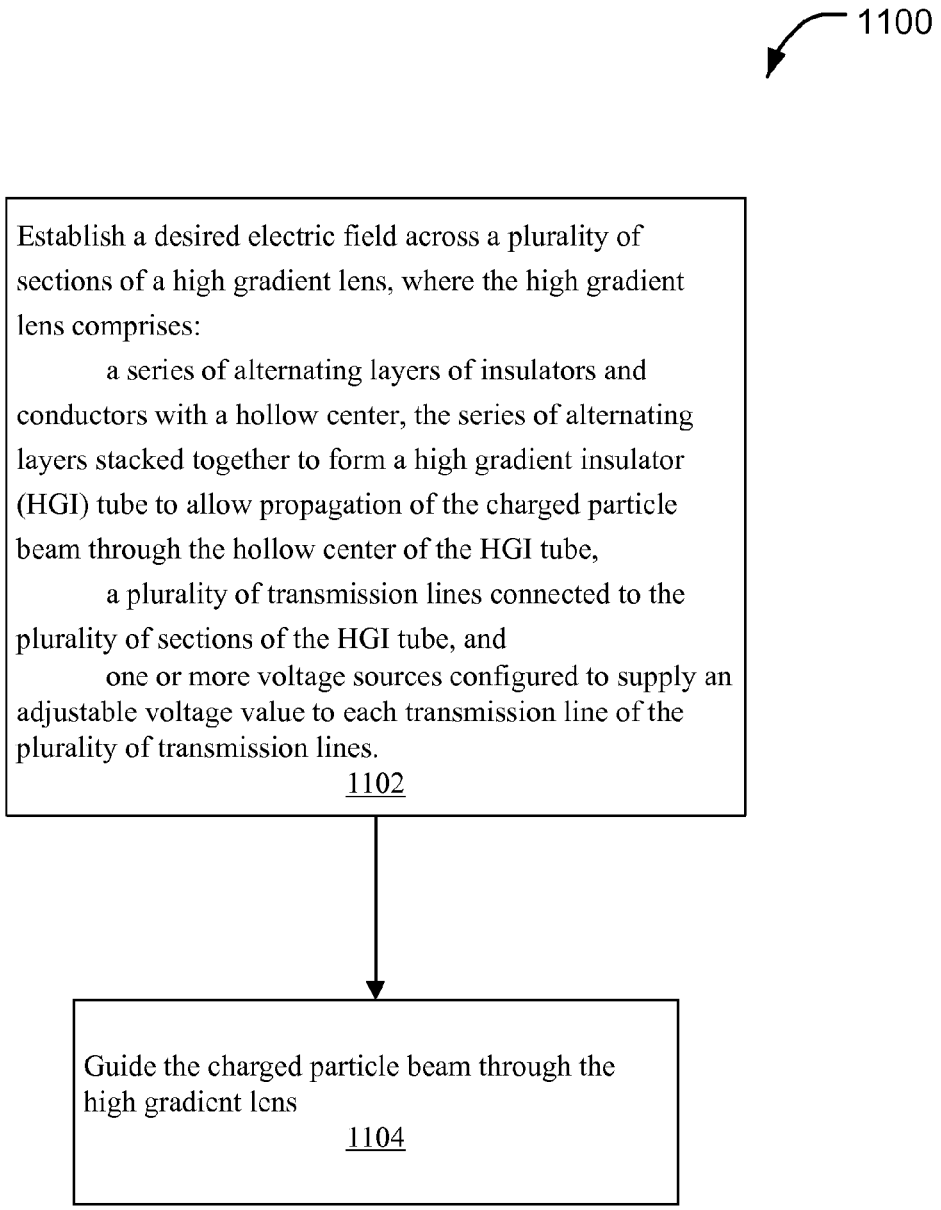
FIG. 11 illustrates a set of operations for shaping a charged particle beam in accordance with an exemplary embodiment of the described technology.

FIG. 11 illustrates a set of operations, generally indicated at 1100, for shaping a charged particle beam in accordance with an exemplary embodiment. At 1102, a desired electric field across a plurality of sections of a high gradient lens is established. The high gradient lens for carrying out this operation includes a series of alternating layers of insulators and conductors with a hollow center, where the series of alternating layers stacked together to form a high gradient insulator (HGI) tube to allow propagation of the charged particle beam through the hollow center of the HGI tube. The high gradient lens further includes a plurality of transmission lines connected to the plurality of sections of the HGI tube, and one or more voltage sources configured to supply an adjustable voltage value to each transmission line of the plurality of transmission lines. At 1104, the charged particle beam is guided by a desired electric field profile through the high gradient lens. This beam focusing operation can be adjustable by changing the focusing from time to time via dynamic control of the voltages applied to the transmission lines. Various applications can benefit from this beam focusing operation.

Figure 12:
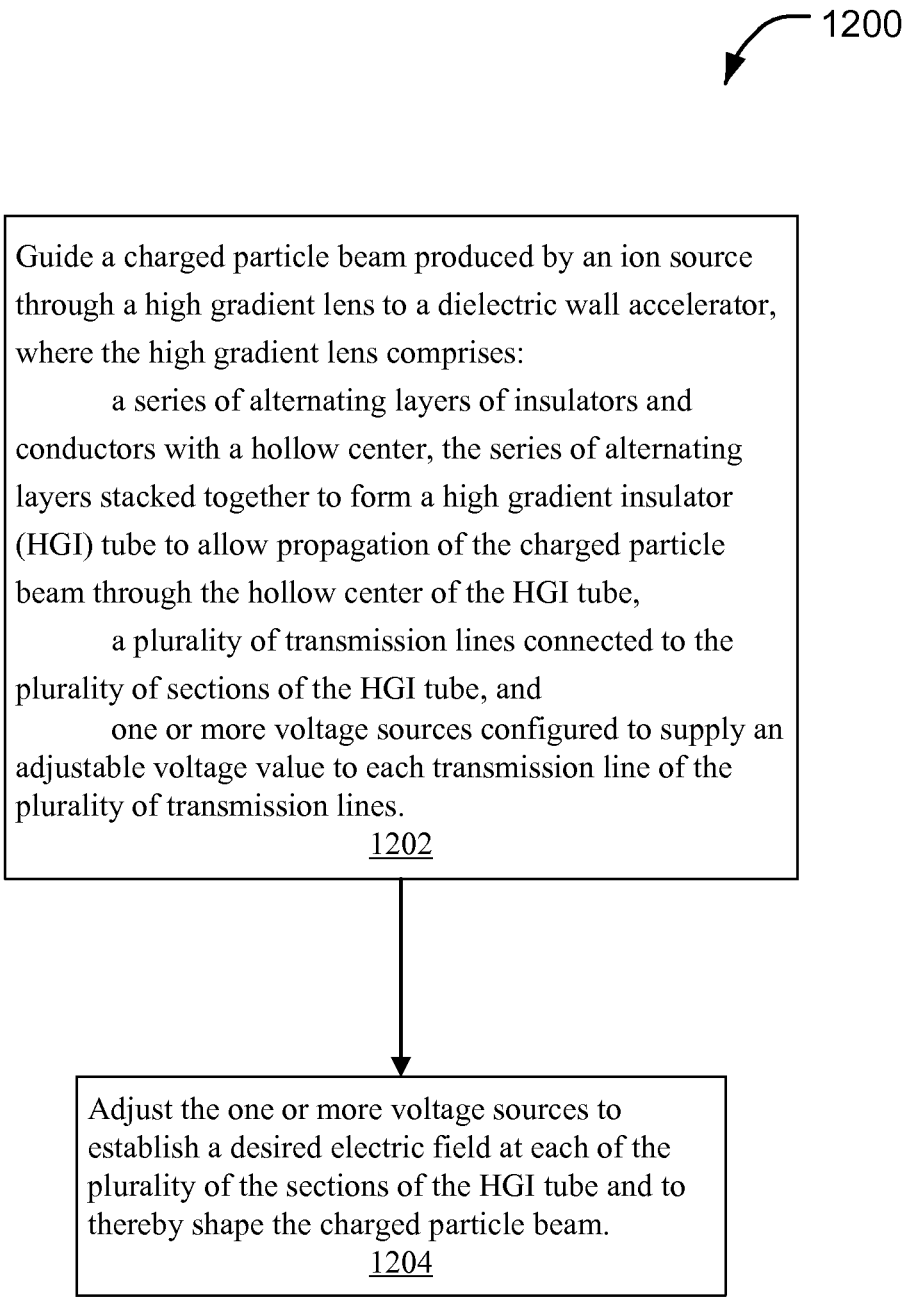
FIG. 12 illustrates a set of operations for operating charged particle accelerator system in accordance with an exemplary embodiment of the described technology.

For example, FIG. 12 illustrates a set of operations, generally indicated at 1200, for operating a charged particle beam accelerator system based on a dielectric wall accelerator. At 1202, a charged particle beam produced by an ion source is guided through a high gradient lens to a dielectric wall accelerator. The high gradient lens includes a series of alternating layers of insulators and conductors with a hollow center, where the series of alternating layers stacked together to form a high gradient insulator (HGI) tube to allow propagation of the charged particle beam through the hollow center of the HGI tube. The high gradient lens also includes a plurality of transmission lines connected to the plurality of sections of the HGI tube, and one or more voltage sources configured to supply an adjustable voltage value to each transmission line of the plurality of transmission lines. At 1204, a desired electric field at each of the plurality of the sections of the HGI tube is established by adjusting the one or more voltage sources, thereby shaping the charged particle beam for a desired acceleration operation by the dielectric wall accelerator coupled to the HGI tube of this high gradient lens.

Figure 13:
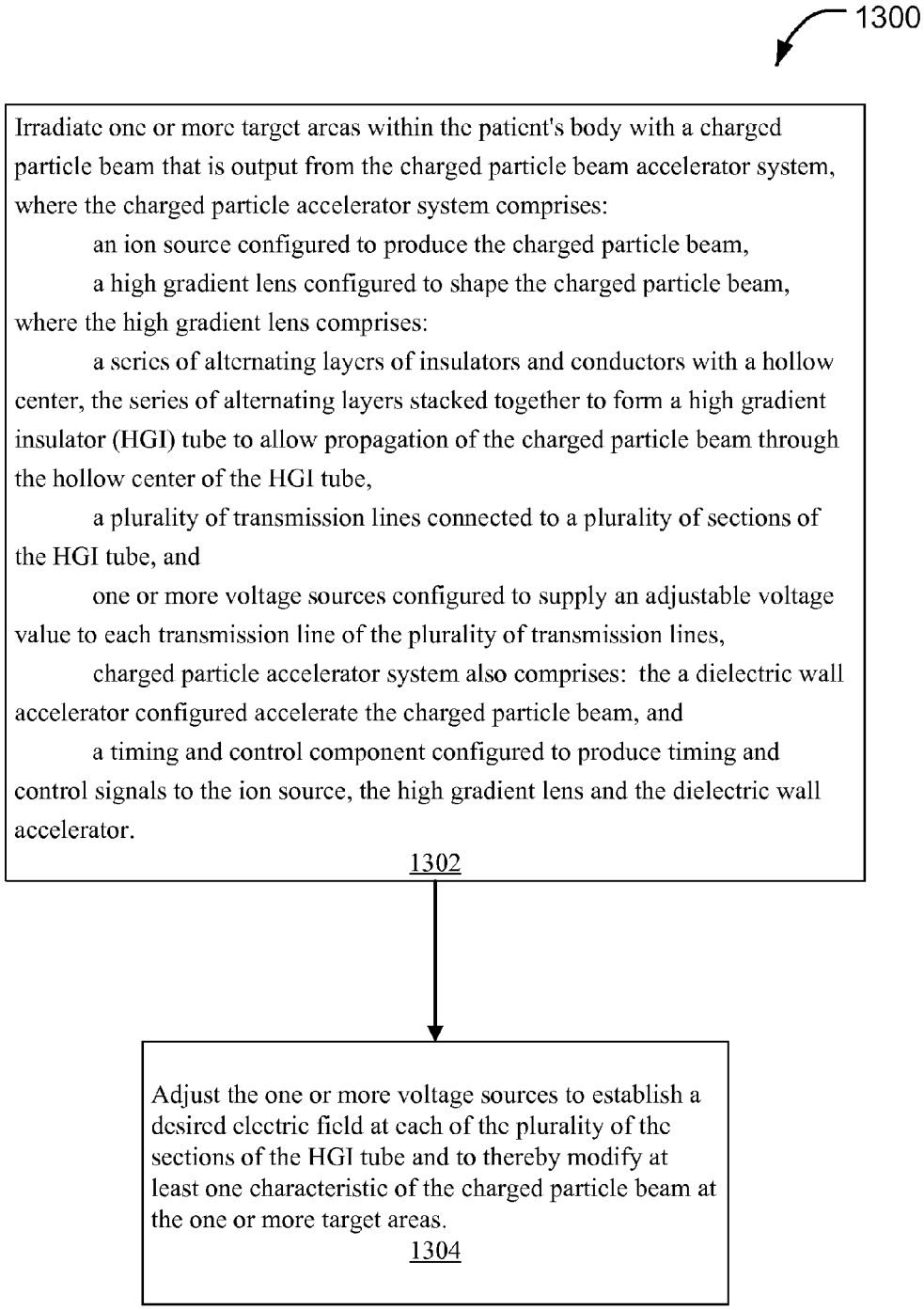
FIG. 13 illustrates a set of operations for treatment of a patient using a charged particle accelerator system in accordance with an exemplary embodiment of described technology.

FIG. 13 illustrates a set of operations, generally indicated at 1300, for treating a patient using a charged particle beam accelerator system in accordance with an exemplary embodiment. At 1302, one or more target areas within the patient's body are irradiated with a charged particle beam that is output from the charged particle beam accelerator system. The charged particle accelerator system comprises an ion source configured to produce the charged particle beam, a high gradient lens configured to shape the charged particle beam, a dielectric wall accelerator configured to accelerate the charged particle beam, and a timing and control component configured to produce timing and control signals to the ion source, the high gradient lens and the dielectric wall accelerator. The high gradient lens of the charged particle accelerator comprises a series of alternating layers of insulators and conductors with a hollow center, where the series of alternating layers stacked together to form a high gradient insulator (HGI) tube to allow propagation of the charged particle beam through the hollow center of the HGI tube. The high gradient lens also includes a plurality of transmission lines connected to a plurality of sections of the HGI tube, and one or more voltage sources configured to supply an adjustable voltage value to each transmission line of the plurality of transmission lines. At 1304, the one or more voltage sources are adjusted to establish a desired electric field at each of the plurality of the sections of the HGI tube and to thereby modify at least one characteristic of the charged particle beam at the one or more target areas.

It is understood that the various embodiments of the present disclosure may be implemented individually, or collectively, in devices comprised of various hardware and/or software modules and components. In describing the disclosed embodiments, sometimes separate components have been illustrated as being configured to carry out one or more operations. It is understood, however, that two or more of such components can be combined together and/or each component may comprise sub-components that are not depicted. Further, the operations that are described in the form of the flow charts in FIGS. 11 through 13 may include additional steps that may be used to carry out the various disclosed operations.

Figure 14:
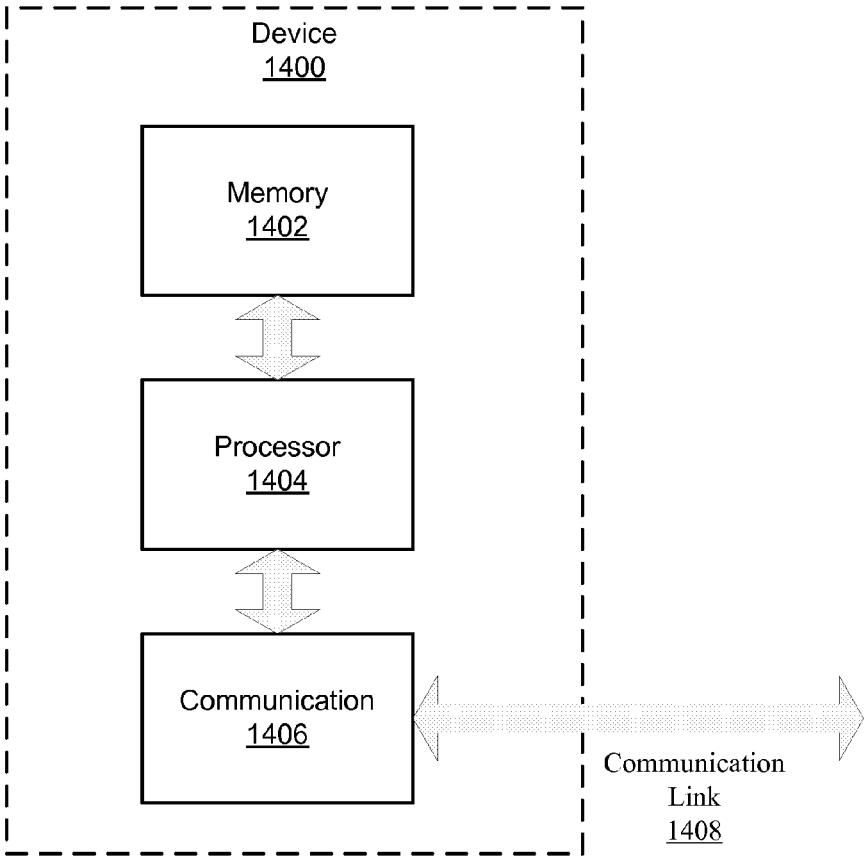
FIG. 14 illustrates a simplified diagram of a device that can be used to control the operations of the components of the disclosed embodiments of the described technology.

In some examples, the devices that are described in the patent document can comprise a processor, a memory unit and an interface that are communicatively connected to each other. For example, FIG. 14 illustrates a block diagram of a device 1400 that can be utilized as part of the timing and control components 116 of FIG. 1, or may be communicatively connected to one or more of the components of FIG. 1. In some example embodiments, the device 1400 may be used to control the timing and the value of voltages that are applied to the high gradient lens that is described in this patent document. The device 1400 comprises at least one processor 1404 and/or controller, at least one memory 1402 unit that is in communication with the processor 1404, and at least one communication unit 1406 that enables the exchange of data and information, directly or indirectly, through the communication link 1408 with other entities, devices, databases and networks. The communication unit 1406 may provide wired and/or wireless communication capabilities in accordance with one or more communication protocols, and therefore it may comprise the proper transmitter/receiver antennas, circuitry and ports, as well as the encoding/decoding capabilities that may be necessary for proper transmission and/or reception of data and other information.

Various embodiments described herein are described in the general context of methods or processes, which may be implemented in one embodiment by a computer program product, embodied in a computer-readable medium, including computer-executable instructions, such as program code, executed by computers in networked environments. A computer-readable medium may include removable and non-removable storage devices including, but not limited to, Read Only Memory (ROM), Random Access Memory (RAM), compact discs (CDs), digital versatile discs (DVD), Blu-ray Discs, etc. Therefore, the computer-readable media described in this patent document include non-transitory storage media. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

While this patent document contains many specifics, these should not be construed as limitations on the scope of any invention or of what may be claimed, but rather as descriptions of features that may be specific to particular embodiments of particular inventions. Certain features that are described in this patent document in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Moreover, the separation of various system components in the embodiments described above should not be understood as requiring such separation in all embodiments.

Only a few implementations and examples are described and other implementations, enhancements and variations can be made based on what is described and illustrated in this patent document. For example, the exemplary embodiments have been described in the context of proton beams. It is, however, understood that the disclosed principals can be applied to other charged particle beams. Moreover, the generation of extremely short charged particle pulses that are carried out in accordance with certain embodiments may be used in a variety of applications that range from radiation for cancer treatment, probes for spherical nuclear material detection or plasma compression, or in acceleration experiments. The features of the embodiments described herein may be combined in all possible combinations of methods, apparatus, modules, systems, and computer program products.

What is claimed is:

1. A high gradient lens, comprising:

a series of alternating layers of insulators and conductors stacked to one another to form a high gradient insulator (HGI) tube having sections with a hollow center to allow propagation of a charged particle beam of charged particles through the hollow center;

a plurality of transmission lines connected to the sections of the HGI tube; and a lens control module configured to supply adjustable voltages the transmission lines, respectively, to thereby establish an adjustable electric field profile over the sections of the HGI tube to effectuate a lens that modifies a spatial profile of the charged particle beam at an output of the HGI tube to achieve a desired beam focusing or defocusing operation.

2. The high gradient lens of claim 1, wherein the lens control module is configured to establish a substantially linear longitudinal electric field across the HGI tube.

3. The high gradient lens of claim 2, wherein the substantially linear longitudinal electric field increases monotonically as a function of distance from entrance of the HGI tube.

4. The high gradient lens of claim 2, wherein the substantially linear longitudinal electric field decreases monotonically as a function of distance from entrance of the HGI tube.

5. The high gradient lens of claim 1, wherein the lens control module is configured to establish a radial electric field at one or more of the sections of the HGI tube and to thereby focus or defocus the charged particle beam propagating through the HGI tube.

6. The high gradient lens of claim 5, wherein the lens control module is configured to establish at least one of:

a positive valued radial electric field to focus a positively charged particle beam;

a positive valued radial electric field to defocus a negatively charged particle beam;

a negative valued radial electric field to focus a negatively charged particle beam; or a negative valued radial electric field to defocus a positively charged particle beam.

7. The high gradient lens of claim 5, wherein the radial electric field is radially symmetric.

8. The high gradient lens of claim 5, wherein the radial electric field is not radially symmetric.

9. The high gradient lens of claim 1, wherein the lens control module is configured to establish a non-linear longitudinal electric field across the HGI tube.

10. The high gradient lens of claim 1, wherein the lens control module is configured to allow operation of the high gradient lens as an Einzel lens.

11. The high gradient lens of claim 1, wherein the lens control module is configured to be adjusted so as to vary the established electric field for at least two separate portions of the charged particle beam that propagate through the HGI tube, and wherein the at least two separate portions are separated in time.

12. The high gradient lens of claim 1, wherein the lens control module is configured to modify at least one characteristic of the charged particle beam that propagates through the HGI tube.

13. The high gradient lens of claim 12, wherein the at least one characteristic of the charged particle beam includes a beam radius;
a beam spot size;
a beam energy;
a beam emittance;
a beam uniformity;
a beam intensity; or
a beam slope.

14. The high gradient lens of claim 1, wherein the lens control module is configured to allow the high gradient lens to perform one or more of: a charged particle beam focusing operation; a charged particle beam defocusing operation; a charged particle beam acceleration operation; and a charged particle beam deceleration operation.

15. The high gradient lens of claim 1, wherein the HGI tube has alternating layers of insulators and conductors that are planer layers that are perpendicular to the axial axis of the HGI tube.

16. The high gradient lens of claim 1, wherein the HGI tube includes a section having alternating dielectric and conductive layers that are either planar layers slanted relative to the axial axis of the HGI tube or are wavy or curved layers.

17. A method of shaping a charged particle beam, comprising:

directing a charged particle beam into a plurality of sections of a high gradient lens, wherein the high gradient lens comprises a series of alternating layers of insulators and conductors stacked to form a high gradient insulator (HGI) tube having sections with a hollow center to allow propagation of the charged particle beam through the hollow center of the HGI tube; and applying adjustable voltages to the sections of the HGI tube to establish a desired electric field at each section and across the sections to shape a spatial profile of the charged particle beam to achieve a desired beam focusing or defocusing operation.

18. The method of claim 17, comprising adjusting the adjustable voltages to establish a substantially linear longitudinal electric field across the HGI tube.

19. The method of claim 17, wherein the substantially linear longitudinal electric field increases monotonically as a function of distance from entrance of the HGI tube.

20. The method of claim 17, wherein the substantially linear longitudinal electric field decreases monotonically as a function of distance from entrance of the HGI tube.

21. The method of claim 17, comprising adjusting the adjustable voltages to establish a radial electric field at one or more of the plurality of sections of the HGI tube and to thereby focus or defocus the charged particle beam propagating through the HGI tube.

22. The method of claim 21, comprising controlling the adjustable voltages to establish at least one of:

a positive valued radial electric field to focus a positively charged particle beam;

a positive valued radial electric field to defocus a negatively charged particle beam;

a negative valued radial electric field to focus a negatively charged particle beam; or a negative valued radial electric field to defocus a positively charged particle beam.

23. The method of claim 21, wherein the radial electric field is radially symmetric.

24. The method of claim 21, wherein the radial electric field is radially not symmetric.

25. The method of claim 17, comprising adjusting the adjustable voltages to establish a non-linear longitudinal electric field across the HGI tube.

26. The method of claim 17, comprising adjusting the adjustable voltages to provide an Einzel lens functionality.

27. The method of claim 17, comprising adjusting the adjustable voltages so as to vary the established electric field for at least two separate portions of the charged particle beam that propagate through the HGI tube, wherein the at least two separate portions are separated in time.

28. The method of claim 17, comprising adjusting the adjustable voltages to modify at least one characteristic of the charged particle beam that propagates through the HGI tube.

29. The method of claim 28, wherein the at least one characteristic of the charged particle beam includes:

a beam radius;
a beam spot size;
a beam energy;
a beam emittance;
a beam uniformity;
a beam intensity; or
a beam slope.

30. The method of claim 17, comprising adjusting the adjustable voltages to perform one or more of: a charged particle beam focusing operation; a charged particle beam defocusing operation; a charged particle beam acceleration operation; or a charged particle beam deceleration operation.

31. The method of claim 17, comprising:

placing the high gradient lens in a circular accelerator to control focusing of the charged particle beam which is accelerated by the circular accelerator; and adjusting the applied adjustable voltages to the sections of the HGI tube to vary beam focusing at different turns of the charged particle beam circulating in the circular accelerator.

32. The method of claim 17, further comprising:

adjusting the one or more voltage sources to change an electric field at one or more of the plurality of the sections of the HGI tube and to thereby modify the focusing or defocusing of the charged particle beam.

33. The method of claim 17, further comprising:

varying at least one characteristic of the charged particle beam that is output from the charged particle accelerator by adjusting the one or more voltage values as a function of time.

34. A charged particle accelerator system, comprising:

a charged particle source configured to produce a charged particle beam;

a high gradient lens configured to receive and shape the charged particle beam, the high gradient lens including a series of alternating layers of insulators and conductors to form a high gradient insulator (HGI) tube having sections with a hollow center to allow propagation of the charged particle beam through the hollow center, and a plurality of transmission lines connected to a plurality of sections of the HGI tube, and one or more voltage sources configured to supply an adjustable voltage value to each transmission line of the plurality of transmission lines;

a dielectric wall accelerator configured to accelerate the charged particle beam; and a timing and control component configured to produce timing and control signals to the charged particle source, the high gradient lens and the dielectric wall accelerator.

35. The charged particle beam accelerator of claim 34, wherein the high gradient lens is positioned between the charged particle source and the dielectric wall accelerator.

36. The charged particle beam accelerator of claim 34, wherein the high gradient lens is incorporated into the dielectric wall accelerator.

37. A method for treatment of a patient using a charged particle accelerator system, the method comprising:

irradiating one or more target areas within the patient's body with a charged particle beam that is output from the charged particle beam accelerator system, the charged particle accelerator system comprising:

a charged particle source configured to produce the charged particle beam, a high gradient lens configured to shape the charged particle beam, the high gradient lens comprising:

a series of alternating layers of insulators and conductors with a hollow center, the series of alternating layers stacked together to form a high gradient insulator (HGI) tube to allow propagation of the charged particle beam through the hollow center of the HGI tube, a plurality of transmission lines connected to a plurality of sections of the HGI tube, and one or more voltage sources configured to supply an adjustable voltage value to each transmission line of the plurality of transmission lines, a dielectric wall accelerator configured to accelerate the charged particle beam, and a timing and control component configured to produce timing and control signals to the charged particle source, the high gradient lens and the dielectric wall accelerator; and adjusting the one or more voltage sources to establish a desired electric field at each of the plurality of the sections of the HGI tube and to thereby modify at least one characteristic of the charged particle beam at the one or more target areas.

38. The method of claim 37, wherein the at least one characteristic of the charged particle beam includes:

a beam radius;

a beam spot size;

a beam energy;

a beam emittance;

a beam uniformity;

a beam intensity; or a beam slope.

* * * * *